US011806568B1

(12) United States Patent
Hong

(10) Patent No.: US 11,806,568 B1
(45) Date of Patent: Nov. 7, 2023

(54) WEIGHT-ADJUSTABLE DUMBBELL

(71) Applicant: Ningbo Haishu Longhao Health Equipment Co., Ltd., Zhejiang (CN)

(72) Inventor: Guonian Hong, Zhejiang (CN)

(73) Assignee: NINGBO HAISHU LONGHAO HEALTH EQUIPMENT CO., LTD., Zhejiang (CN)

( * ) Notice: Subject to any disclaimer, the term of this patent is extended or adjusted under 35 U.S.C. 154(b) by 0 days.

(21) Appl. No.: 18/139,383

(22) Filed: Apr. 26, 2023

(30) Foreign Application Priority Data

Apr. 27, 2022 (CN) ..... 202221046325.X
Aug. 20, 2022 (CN) ..... 202222199803.7

(51) Int. Cl.
*A63B 21/072* (2006.01)
*A63B 21/075* (2006.01)

(52) U.S. Cl.
CPC ..... *A63B 21/0726* (2013.01); *A63B 21/075* (2013.01); *A63B 21/0728* (2013.01)

(58) Field of Classification Search
CPC ..... A63B 21/072; A63B 21/0726; A63B 21/0728; A63B 21/075
See application file for complete search history.

(56) References Cited

U.S. PATENT DOCUMENTS 11,167,167 B1 * 11/2021 Weng ..... A63B 21/0726
11,471,722 B2 * 10/2022 Lu ..... A63B 21/075
11,484,745 B1 * 11/2022 Weng ..... A63B 21/0726
2007/0184945 A1 * 8/2007 Lin ..... A63B 21/075 482/107
2008/0070761 A1 * 3/2008 Lin ..... A63B 21/075 482/107
2009/0305852 A1 * 12/2009 Hoglund ..... A63B 21/0728 482/107
2010/0323856 A1 * 12/2010 Svenberg ..... A63B 21/075 482/108
2015/0367163 A1 * 12/2015 Moran ..... A63B 71/0036 482/108
2018/0264308 A1 * 9/2018 Wang ..... A63B 21/075
2018/0353794 A1 * 12/2018 Wang ..... A63B 71/0036
2022/0096890 A1 * 3/2022 Lu ..... A63B 21/0728
2022/0249898 A1 * 8/2022 Jiang ..... A63B 21/0728

* cited by examiner

*Primary Examiner* — Joshua Lee
(74) *Attorney, Agent, or Firm* — COOPER LEGAL GROUP, LLC

(57) ABSTRACT

The present application relates to a weight-adjustable dumbbell, which includes a holding rod assembly, a handle tube, a hanging mechanism, a gear fixing mechanism, and a counterweight assembly connected to the holding rod assembly and including at least one dumbbell plate. The handle tube is rotatably installed, and the hanging mechanism is connected to the handle tube and rotated synchronously with the handle tube. The hanging mechanism is defined with a plurality of gear positions rotating relative to the counterweight assembly under a drive of the handle tube, and configured to connect to at least one dumbbell plate when the hanging mechanism is rotated to one of the gear positions. The gear fixing mechanism is connected to the hanging mechanism and rotated synchronously with the hanging mechanism, and the gear fixing mechanism keeps the hanging mechanism having a movement tendency of rotating toward one of the gear positions.

13 Claims, 25 Drawing Sheets

WEIGHT-ADJUSTABLE DUMBBELL

CROSS REFERENCE TO RELATED APPLICATIONS

The present application claims the priority to China Patent No. 202222199803.7, filed on Aug. 20, 2022, and China Patent No. 202221046325.X, filed on Apr. 27, 2022. The entireties of China Patent No. 202222199803.7 and China Patent No. 202221046325.X are incorporated herein by reference and made a part of this specification.

TECHNICAL FIELD

The application relates to the field of fitness equipment, and, in particular, to a weight-adjustable dumbbell.

BACKGROUND

The main use of dumbbells is for muscle strength training. Currently, dumbbells on the market can be divided into two types: fixed weight and adjustable weight. Among them, weight-adjustable dumbbells have better applicability because they can adjust their weight to meet needs of different training intensities.

Existing weight-adjustable dumbbells include a holding rod assembly and a counterweight assembly. Two ends of the holding rod assembly are respectively provided with a plurality of hanging plates which are adjacently arranged and can synchronously rotate; each hanging plate corresponds to one dumbbell plate, and by rotating the hanging plates to different gear positions, the corresponding dumbbell plate can be selected or loosened. By adjusting the number of the dumbbell plates connected to the holding rod assembly, the weight of the dumbbell can be adjusted.

However, in actual use of the above-mentioned dumbbell, if the user does not rotate the hanging plate to a set gear position, that is, when the hanging plate is rotated between two adjacent gear positions, the hanging plate and its corresponding dumbbell plate will be in a semi-engaged state. At this time, although the holding rod assembly can drive the dumbbell plate to be lifted together, the dumbbell plate is easy to detach from its corresponding hanging plate during lifting, and thus great potential safety hazards can be caused to users.

BRIEF SUMMARY

An object of the present application is to provide a weight-adjustable dumbbell in which a hanging mechanism and a dumbbell plate will not be in a semi-engaged state when the dumbbell is lifted, reducing a risk of injury to a user caused by the dumbbell plate falling off during exercise.

In a first aspect, the present application provides a weight-adjustable dumbbell, adopting the following technical solution.

A weight-adjustable dumbbell, including a holding rod assembly and two groups of counterweight assembly configured to be hung on two opposite sides of the holding rod assembly, wherein each group of the counterweight assembly includes at least one dumbbell plate.

The holding rod assembly includes:

a handle tube configured to rotate circumferentially, and the handle tube is provided with a positioning member rotating synchronously;

two load-bearing members, connected to both ends of the handle tube and rotated relative to the handle tube, and each of the load-bearing member is defined with at least one stop groove;

two hanging members movably connected to both ends of the handle tube respectively, and provided with a spiral guide groove for the positioning member to spirally move around and a stop block matching the stop groove and sliding axially; the hanging member is defined with a plurality of gear positions sliding relative to the dumbbell plate under a drive of the handle tube, and configured to connect to at least one dumbbell plate when the hanging member is slid to one of the gear positions, and the hanging member increasing or decreasing a number of the dumbbell plate to be hanged one by one; and, two gear fixing plates connected to both ends of the handle tube and rotated synchronously with the handle tube, and the gear fixing plate keeps the hanging member having a movement tendency of sliding to one of the gear positions.

In some embodiments, the holding rod assembly further includes an inner end cover fixed relatively to the load-bearing member, the inner end cover is defined with an installation groove for the gear fixing plate to be installed and to rotate relatively, and a plurality of limit grooves is defined on the gear fixing plate annularly, the inner end cover is internally and slidably provided with a plurality of stop members snapped into the limit grooves to limit a relative rotation between the gear fixing plate and the inner end cover.

In some embodiments, the gear fixing plate includes a gear fixing ring arranged on a plate surface on one side; the gear fixing ring is circumferentially defined with a plurality of positioning recesses at intervals, and each of the positioning recess corresponds to one of the gear positions respectively; and the inner end cover is internally and slidably provided with at least one gear fixing member abutting against the gear fixing ring, the gear fixing member always has a movement tendency of being moved into the positioning recess; the hanging member is configured to slide to the gear position corresponding to the positioning recess when the gear fixing member is snapped into the positioning recess part.

In some embodiments, the handle tube includes a holding portion and an installation portion connected to both ends of a body of the holding tube, the holding portion is provided with a snap base on one side departing from the body of the holding tube, and the snap base is configured to be in snap connection with a ring hole of the gear fixing ring, and defined with a perforation for installing the positioning member.

In some embodiments, a sliding convex portion is formed between two adjacent positioning recesses, and the gear fixing member is in liner contact with the sliding convex portion.

In some embodiments, the gear fixing member includes an abutting portion and a guide portion connected to one side of the abutting portion, and the contact part abuts against the gear fixing ring; the inner end cover is internally defined with a first sliding groove and a second sliding groove interconnected with each other, and an width of the first sliding groove is greater than that of the second sliding groove, the abutting portion is configured for snapping into the first sliding groove and sliding back and forth along a radial direction of the inner end cover, the guide portion is configured for snapping into the second sliding groove and sliding back and forth along the radial direction of the inner end cover.

In some embodiments, the dumbbell plate is defined with a hanging opening matching the hanging member and configured for an axial insertion of the hanging member, and a rotation stop notch communicating with the hanging opening and configured for the load-bearing member to vertically snap in; with an opening at a joint between the rotation stop notch and the hanging opening being smaller than the hanging opening.

In some embodiments, the dumbbell plate is defined with a chamfer at an edge.

In some embodiments, the dumbbell further includes a dumbbell seat, and the dumbbell seat is defined with an unlocking member at a position corresponding to the inner end cover, and configured to force the unlocking member to disengage from the limit groove.

In some embodiments, a notch is defined at a bottom of the dumbbell plate, and the dumbbell seat is provided with a stop bar at a position corresponding to the dumbbell plate, and configured to be inserted into the notch.

In a second aspect, the present application provides a weight-adjustable dumbbell, adopting the following technical solution.

A weight-adjustable dumbbell, including:

two groups of counterweight assemblies, wherein each group of the counterweight assemblies includes at least one dumbbell plate; and a holding rod assembly, the two groups of counterweight assemblies are respectively connected to both ends of the holding rod assembly, wherein the holding rod assembly includes:

a handle tube rotatably installed;

a hanging mechanism connected to the handle tube and rotated synchronously with the handle tube, and the hanging mechanism is defined with a plurality of gear positions rotating relative to the counterweight assembly under a drive of the handle tube; and configured to connect to at least one dumbbell plate when the hanging mechanism is rotated to one of the gear positions; and, the gear fixing mechanism connected to the hanging mechanism and rotated synchronously with the hanging mechanism, wherein the gear fixing mechanism keeps the hanging mechanism having a movement tendency of rotating toward one of the gear positions.

In some embodiments, the gear fixing mechanism includes:

a gear fixing plate connected to the handle tube and rotated synchronously with the handle tube, wherein the gear fixing plate is circumferentially defined with a plurality of positioning recesses at intervals, and each of the positioning recess corresponds to one of the gear positions respectively;

an inner end cover, wherein the gear fixing plate is rotatably installed on the inner end cover; and an elastic assembly, wherein the elastic assembly is slidably installed on the inner end cover, abuts against the gear fixing plate, and constantly has a movement tendency of being moved into the positioning recess;

wherein, the hanging mechanism is configured to be rotated to a corresponding positioning recess potion when the elastic assembly is snapped into the positioning recess.

In some embodiments, at least two of the elastic assemblies are circumferentially arranged on the inner end cover at intervals.

In some embodiments, a sliding convex portion is formed between two adjacent positioning recesses, and the elastic assembly is in linear contact with the sliding convex portion.

In some embodiments, a sliding groove is defined in the inner end cover, and the elastic assembly is slidably installed in the sliding groove; wherein, the elastic assembly is an integrated structure, including:

an abutting member abutting against the gear fixing plate; and an elastic member supported between the abutting member and a bottom of the sliding groove.

In some embodiments, the abutting member includes a connecting surface, the elastic member includes a spring, and the spring abuts against the connecting surface and a bottom of the sliding groove, and a cross-sectional shape of the spring has a shape matching the connecting surface.

In some embodiments, a guide hole is defined in the inner end cover, and the elastic assembly is slidably installed in the guide hole; and the elastic assembly is an integrated structure, including:

an abutting portion abutting against the gear fixing plate; and an elastic rebounding portion, wherein the elastic rebounding portion is connected to the abutting portion and arranged near periphery of the abutting portion, with a gap between the elastic rebounding portion and the abutting portion, and the elastic rebounding portion is configured to slidably abut against an inner wall of the guide hole;

wherein, the elastic rebounding portion is configured to be compressed by the inner wall of the guide hole to move away from the gear fixing plate, and rebound under an action of elastic potential energy to move toward the gear fixing plate.

In some embodiments, the guide hole includes a contracting cavity and a restoring cavity interconnected with each other; a size of the restoring cavity is larger than that of the contraction cavity, and the elastic rebounding portion is configured to be compressed to move toward the contracting cavity or rebound toward the restoring cavity.

In some embodiments, the holding rod assembly further includes a stop mechanism installed on the inner end cover and configured to lock a rotation of the gear fixing plate or unlock the rotation of the gear fixing plate under an action of an external unlocking assembly.

In some embodiments, the dumbbell further includes a dumbbell seat configured to receive the counterweight assembly and provided with the unlocking assembly configured to act on the stop mechanism to unlock the rotation of the gear fixing plate when the holding rod assembly is placed on the dumbbell seat.

In summary, embodiments of the present application have the following beneficial effects.

1. By using the hanging member of the present application, all of the dumbbell plates except the last one to be hung can be in a fully engaged state, avoiding a situation where a plurality of dumbbell plates are in a semi-engaged state at the same time. With the gear fixing plate, the hanging member can be automatically adjusted to be fully engaged with the last dumbbell plate to be hung, thus effectively reducing a risk of injury to the user caused by the dumbbell plate falling off during exercise.

2. Through installing of the inner end cover and the stop member in the present application, an adjustment of the gear position of the dumbbell can only be performed when the stop member is released from the limit groove. After the hanging member slides to a set gear position, the stop member can then be driven into the limit groove to lock the gear position, which can further increase a security of the dumbbell during use.
3. Through installing of the positioning recess and the sliding convex portion in the present application, that is, a convex edge of the gear fixing ring is sharper, there is always a relative movement tendency between the gear fixing member and the sliding convex portion, and the gear fixing member can be guided to fall into the positioning recess, so as to realize automatic returning to the gear position, without the need of manual intervention.
4. The dumbbell seat has a simple structure and low production cost.

DETAILED DESCRIPTION

Figure 1:
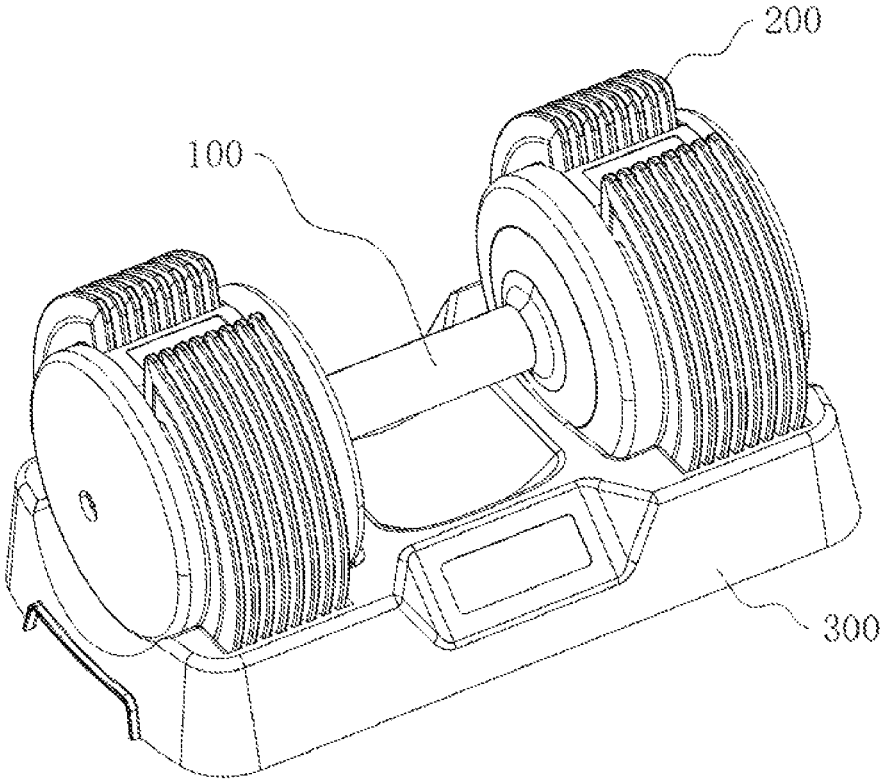
FIG. 1 is a structure view of the weight-adjustable dumbbell.

With reference to FIG. 1-24, the present application will be further described in details.

An embodiment of the present application discloses a weight-adjustable dumbbell.

The weight-adjustable dumbbell includes a holding rod assembly 100, a counterweight assembly 200, and a dumbbell seat 300. The counterweight assembly 200 is provided with two groups, and two groups of the counterweight assembly 200 are respectively connected to both ends of the holding rod assembly 100. Each group of the counterweight assembly 200 includes at least one dumbbell plate 210, a number of the dumbbell plate 210 can be adjusted as needed. The dumbbell seat 300 is configured to receive the counterweight assembly 200.

The holding rod assembly 100 is configured to be automatically adjusted to be fully engaged with a dumbbell plate 210 having a set weight, thereby reducing a risk of injury to the user caused by the dumbbell plate 210 falling off during exercise.

The holding rod assembly 100 includes a handle tube 110, a hanging mechanism 120, a gear fixing mechanism 130 and a stop mechanism 140. The hanging mechanism 120 is connected to the handle tube 110. By rotating the handle tube 110, the hanging mechanism 120 rotates synchronously with the counterweight assembly 200, and the hanging mechanism 120 is configured to hang at least one of the dumbbell plate 210 when the hanging mechanism 120 is rotated to one of the gear positions relative to the counterweight assembly 200. By rotating the handle tube 110, the user makes the holding rod assembly 100 hang different weight combinations of dumbbell plates 210 at different gears. The gear fixing mechanism 130 is connected to the hanging mechanism 120 and rotated synchronously with the hanging mechanism 120. The gear fixing mechanism 130 keeps the hanging mechanism 120 having a movement tendency of rotating toward one of the gear positions. When the user adjusts the gear position by rotating the handle tube 110, if the rotation is not in place, the hanging mechanism 120 may be in a semi-engaged state with the counterweight assembly 200. At this time, the gear fixing mechanism 130 keeps the hanging mechanism 120 continuing to rotate until the hanging mechanism 120 rotates to a certain set gear. This prevents the dumbbell from being in semi-engaged state when being lifted.

Embodiment 1

Figure 2:
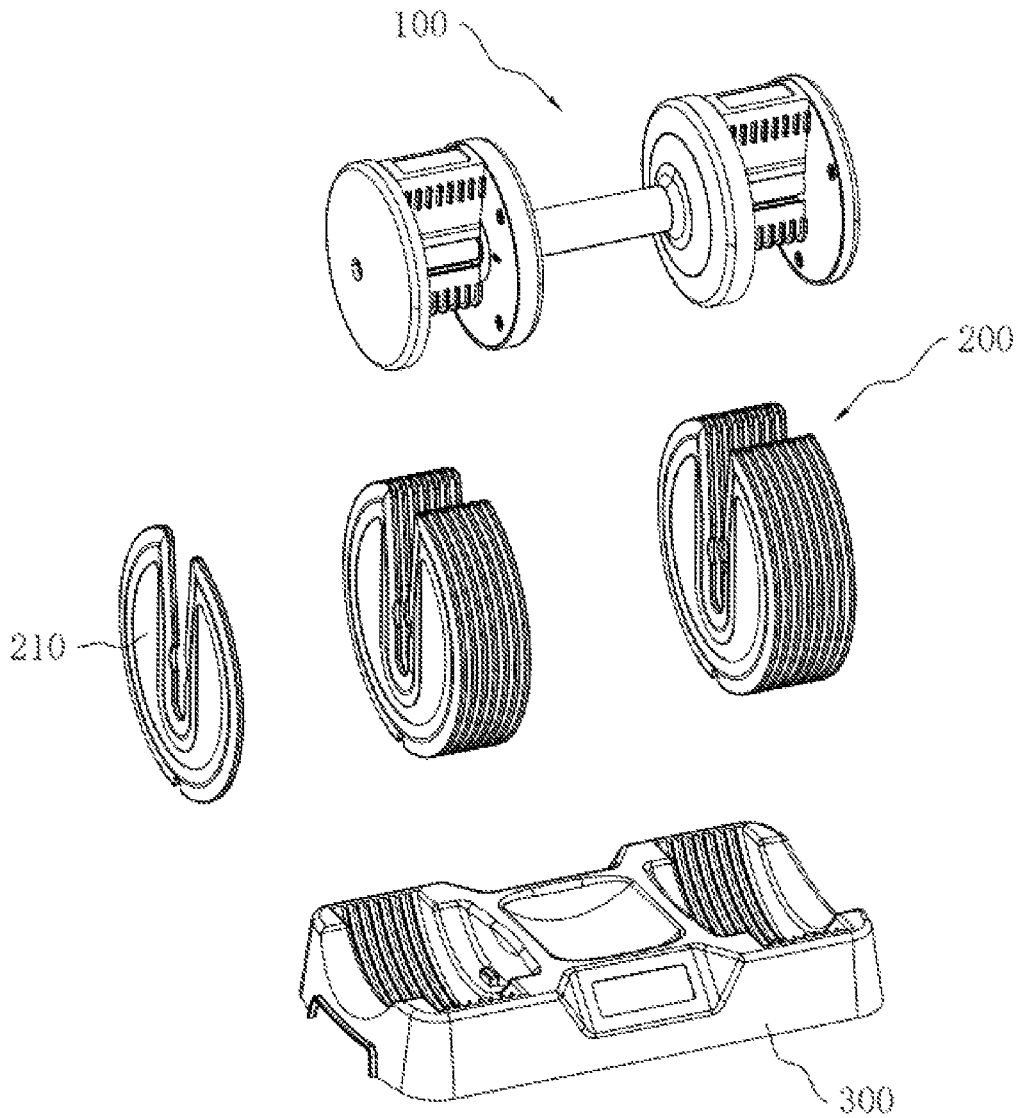
FIG. 2 is an exploded structure view of the weight-adjustable dumbbell.

Referring to FIG. 1 and FIG. 2, each group of the counterweight assembly 200 in this Embodiment includes eight dumbbell plates 210, and shape of the dumbbell plate 210 is a round plate. In other embodiments, the shape of the dumbbell plate 210 can also be a triangular plate, a polygonal plate, etc. Multiple dumbbell plates 210 can be of a same size or of different sizes.

Figure 3:
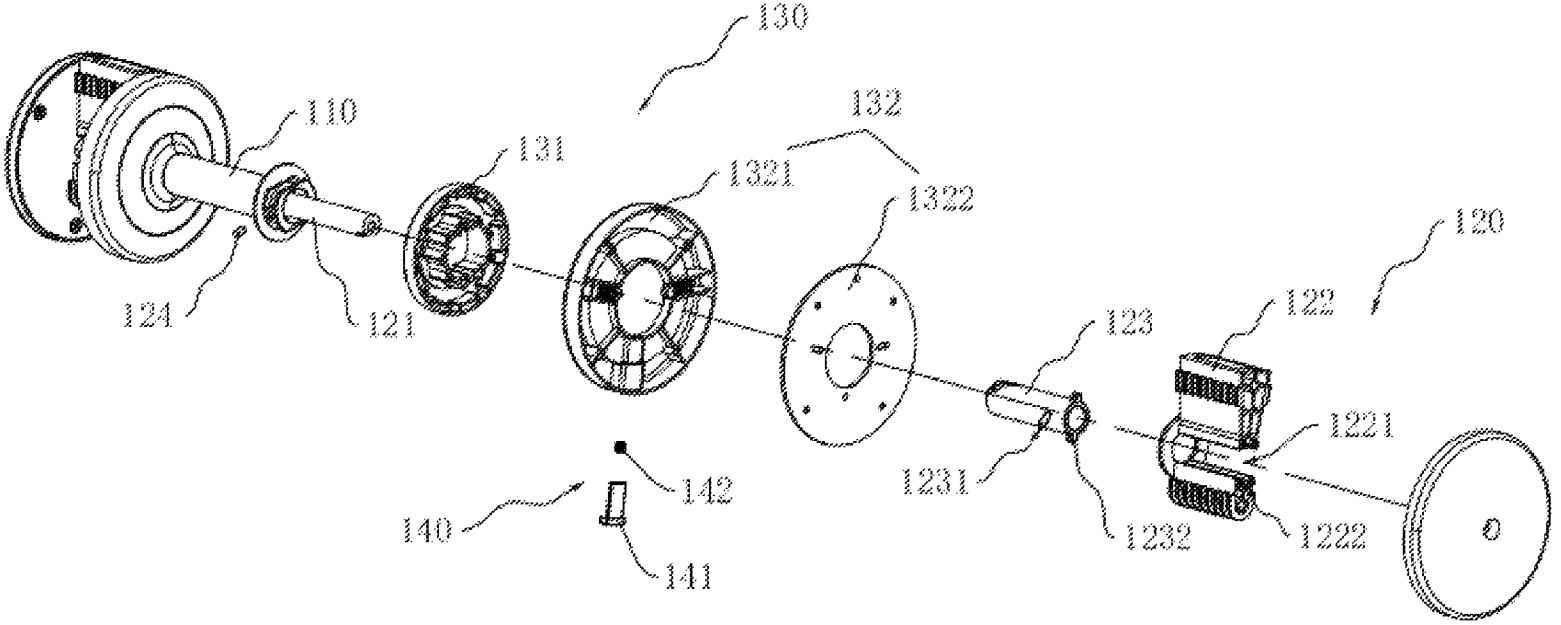
FIG. 3 is an exploded structure view of the holding rod assembly.
Figure 4:
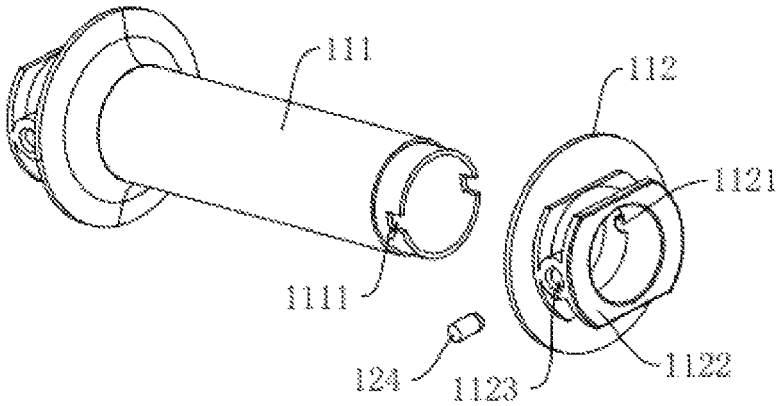
FIG. 4 is an exploded structure view of the handle tube.

Referring to FIG. 3 and FIG. 4, the handle tube 110 includes a holding portion 111 and an installation portion 112 connected at both ends of the holding portion 111. The end of the holding portion 111 is inserted into the installation portion 112, the installation portion 112 is annular and an inner wall of the installation portion 112 is defined with a plurality of fixture block 1121 at intervals, and at the end of the holding portion 111 is defined with a notch 1111 for axially inserting of the fixture block 1121. The holding portion 111 is relatively fixed with the installation portion 112 by inserting the fixture block 1121 into the notch 1111.

Figure 5:
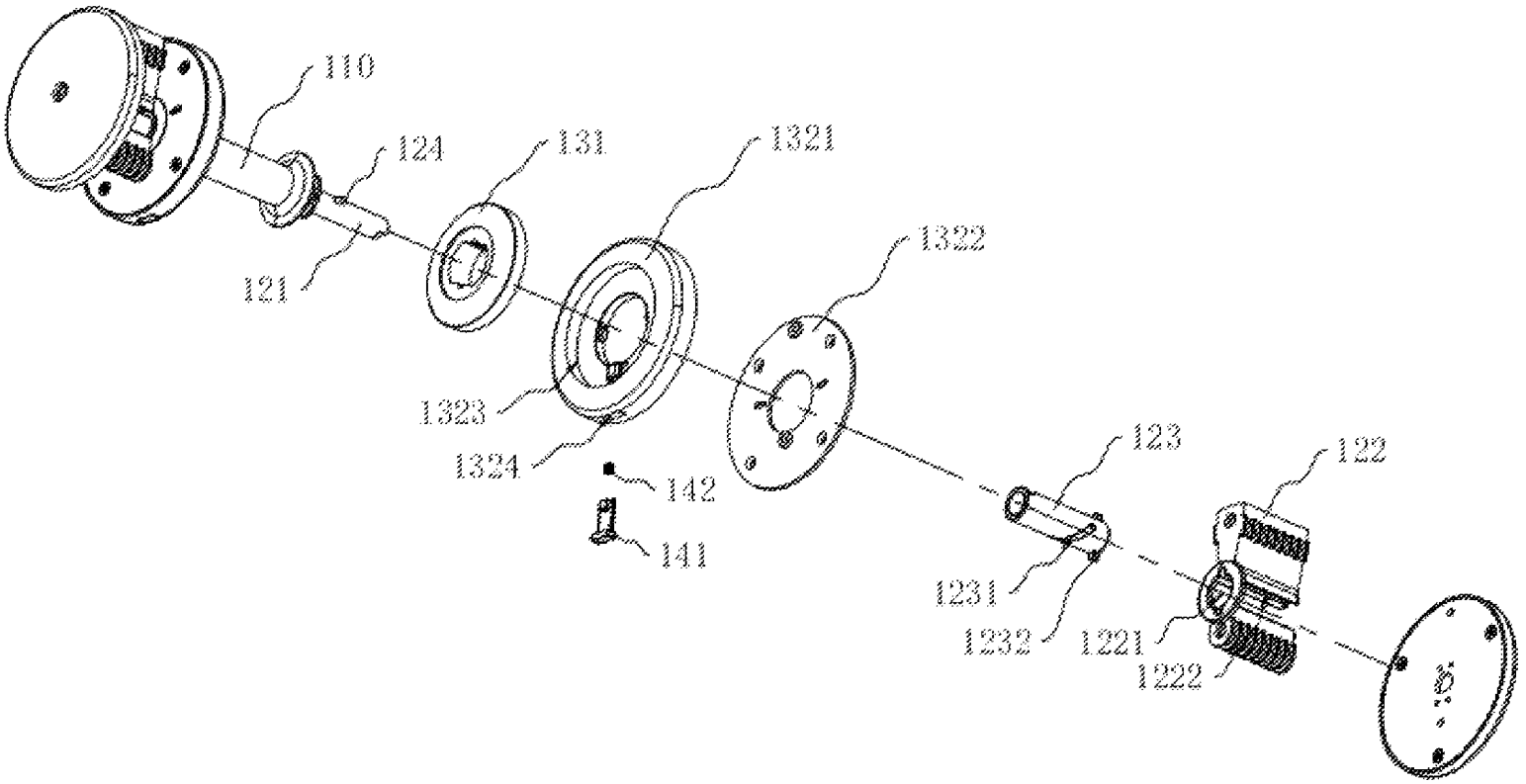
FIG. 5 is an exploded structure view of the holding rod assembly.

Referring to FIG. 3 and FIG. 5, the hanging mechanism 120 includes a central shaft 121, a load-bearing member 122 and a hanging member 123. The handle tube 110 is sleeved on the central shaft 121. Both ends of the handle tube 110 are respectively provided with a synchronously rotated positioning member 124. In this Embodiment, the positioning member 124 is a spring plunger. In other embodiments, the positioning member 124 can also be a structure with guiding and limiting action such as a convex column, etc. The number of the positioning member 124 can be increased as needed. The load-bearing member 122 and the handle tube 110 is rotatably connected. The load-bearing member 122 is defined with a sliding groove 1221 and a stop groove 1222. The sliding groove 1221 is located at middle of the load-bearing member 122 for axial sliding of the hanging member 123. The hanging member 123 is tubular in shape and is movably connected to the handle tube 110. The hanging member 123 is defined with a spiral guiding groove 1231 and a stop block 1232 configured to slide axially with the stop groove 1222.

Rotating the handle tube 110 can cause the hanging member 123 to smoothly slide in the sliding groove 1221, thereby causing the hanging member 123 to slide relative to the dumbbell plates 210. The hanging member 123 is configured to connect to at least one dumbbell plate 210 when the hanging member 123 is rotated to one of the gear positions.

Figure 6:
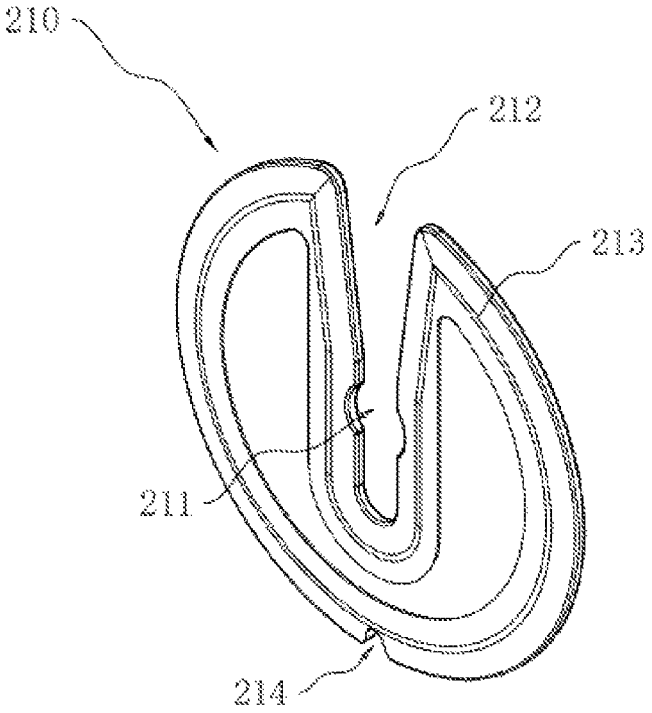
FIG. 6 is a structure view of the dumbbell plate.

Referring to FIG. 5 and FIG. 6, in order to conduct an adjustment of the weight of the dumbbell by hanging different weight combinations of dumbbell plates 210 on the hanging member 123, each of the dumbbell plate 210 is defined with a hanging opening 211 matching the hanging member 123 in this Embodiment that passes through both sides of the dumbbell plate 210. The hanging member 123 is inserted into the hanging opening 211 to hang the dumbbell plate 210.

Furthermore, the dumbbell plate 210 is further defined with a rotation stop notch 212. The hanging opening 211 is located at a center of the dumbbell plate 210. The rotation stop notch 212 communicates with the hanging opening 211 and radially extends to an edge of the dumbbell plate 210. The load-bearing member 122 is configured to be vertically inserted into the rotation stop notch 212 to prevent the dumbbell plate 210 from rotating, making it easy to connect the dumbbell plates 210 neatly to the both ends of the holding rod assembly 100 after hanging. An opening of the rotation stop notch 212 has a flaring shape, which not only prevents the hanging member 123 inserted into the hanging opening 211 from disengaging away from the rotation stop notch 212, but also facilitates the load-bearing member 122 to be quickly inserted into the rotation stop notch 212 for positioning.

A chamfer 213 is defined at the edge of the dumbbell plate 210 to make the edge of the dumbbell plate 210 smooth, reducing the risk of the user being cut by the dumbbell plate 210.

Figure 7:
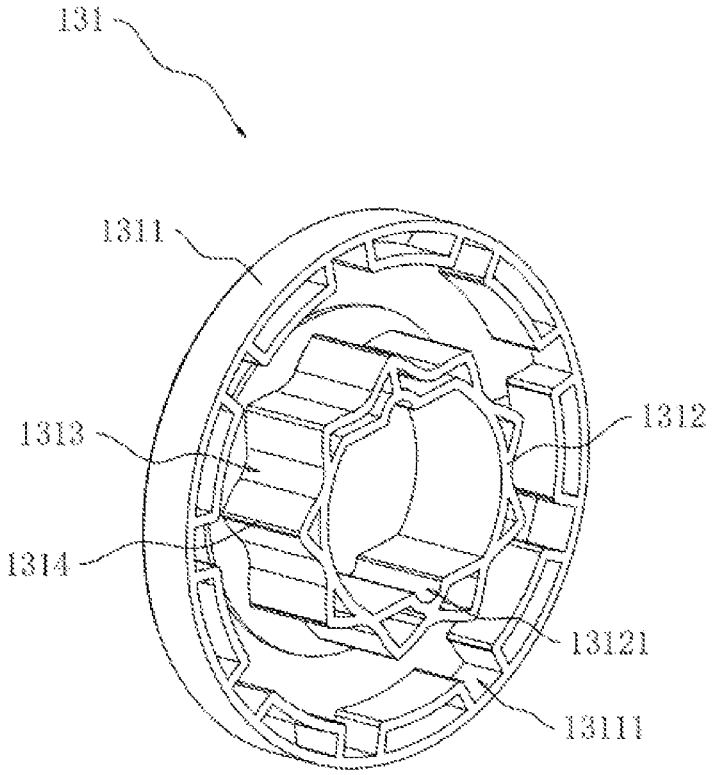
FIG. 7 is a structure view of the gear fixing plate.
Figure 8:
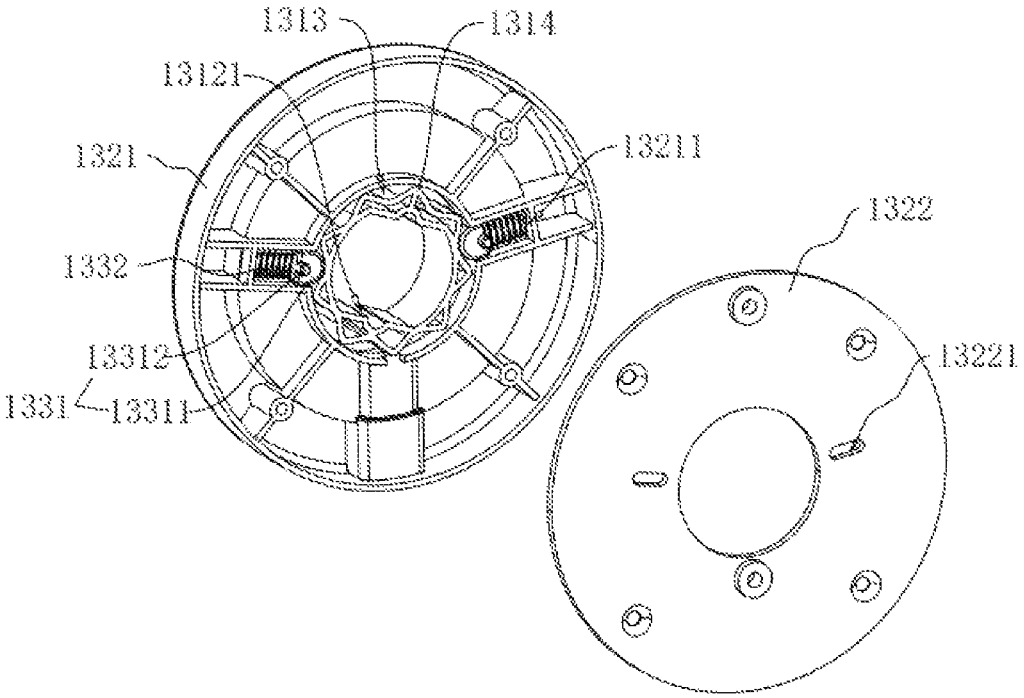
FIG. 8 is a structure view of the gear fixing plate engaged in the inner end cover.

Referring to FIG. 7 and FIG. 8, the gear fixing mechanism 130 includes a gear fixing plate 131, an inner end cover 132 and an elastic assembly 133. The load-bearing member 122 is fixedly connected to the inner end cover 132. The inner end cover 132 is defined with an installation groove 1323 on one side facing the handle tube 110. The gear fixing plate 131 is rotatably installed in the installation groove 1323. The gear fixing plate 131 includes a plate body 1311 and a gear fixing ring 1312. The gear fixing ring 1312 is defined with a plurality of positioning recesses 1313 annularly, and a sliding convex portion 1314 is formed between adjacent positioning recesses 1313.

The elastic assembly 133 includes an abutting member 1331 and a first elastic member 1332. The abutting member 1331 is configured to slide and engage with the positioning recess 1313 to limit a relative rotation between the gear fixing plate 131 and the inner end cover 132, and the abutting member 1331 is in linear contact with the sliding convex portion 1314, allowing the abutting member 1331 to constantly have a relative movement tendency with the sliding convex portion 1314 and move into the positioning recess 1313.

To increase the smoothness of the abutting member 1331 driving the gear fixing ring 1312 to rotate, the inner end cover 132 is preferably provided with two abutting member 1331 in this Embodiment at intervals. Each abutting member 1331 includes an abutting portion 13311 abutting against the gear fixing ring 1312 and a guide portion 13312 connected to one side of the contact portion 13311. The abutting member 1331 achieves automatic returning to the gear fixing ring 1312 through the abutting portion 13311.

Referring to FIG. 8, the inner end cover 132 includes an inner cover body 1321 and an inner cover plate 1322. The inner cover plate 1322 is connected to the inner cover body 1321 on one side away from the handle tube 110 by bolts or other fasteners. The inner cover body 1321 is defined with a first sliding groove 13211 configured for the abutting portion 13311 to snap and slide radially back and forth along the inner cover body 1321. The inner cover plate 1322 is defined with a second sliding groove 13221 configured for the guide portion 13312 to snap in and slide radially back and forth along the inner cover plate 1322. The first sliding groove 13211 communicates with the second sliding groove 13212. A width of the sliding groove 13211 is bigger than that of the second sliding groove 13212. The engagement between the guide portion 13312 and the second sliding groove 13212 helps the contact portion 13311 to be stably limited in the first sliding groove 13211 and smoothly guide its sliding movement, thereby improving the engagement effect between the abutting member 1331 and the gear fixing ring 1312.

The first elastic member 1332 is a spring, one end of which abuts against one side wall of the first sliding groove 13212, the other end abuts against the abutting portion 13311 on the side away from the gear fixing ring 1312.

The installation portion 112 is provided with a snap base 1122 on one side departing from the holding portion 111, and the snap base 1122 is configured to be in snap connection with a ring hole of the gear fixing ring 1312. The snap base 1122 is defined with a perforation 1123 for installing the positioning member 124. The positioning member 124 is inserted through the snap base 1122 and can be limited between the gear fixing ring 1312 and the hanging member 123 to reduce a risk of disengagement and increase a stability of an installation of the positioning member 124 to a certain extent.

Since the positioning member 124 needs to be slid into the guiding groove 1231 of the hanging member 123, the hanging member 123 needs to be oriented during installation. In order to facilitate the engagement between the hanging member 123 and the positioning member 124, two positioning grooves 13121 configured for the stop block 1232 to slide in are further defined in a hole wall of the ring hole of the gear fixing ring 1312. The stop block 1232 can be quickly aligned the positioning member 124 with the guiding groove 1231 by sliding along the positioning groove 13121, thereby helping to improve an installation efficiency of the hanging member 123.

The stop mechanism 140 includes a stop member 141 and a second elastic member 142. The plate body 1311 is defined with a plurality of limit grooves 13111, and the stop member 141 can be locked into the limit groove 13111. The adjustment of the gear position of the dumbbell needs to be performed when the stop member 141 is disengaged from the limit groove 13111. After the hanging member 123 slides to the set gear position, the stop member 141 is driven to lock into the limit groove 13111 to further increase the safety of the dumbbell during use.

Multiple stop members 141 can be arranged in each of the inner end covers 132, but one is sufficient to achieve a good locking effect. In order to reduce production costs, one is used in this Embodiment. The inner end cover 132 is defined with a snap-in groove 1324 for the stop member 141 to slide radially, and one side of the snap-in groove 1324 communicates with the installation groove 1323. The second elastic member 142 is installed at a bottom of the snap-in groove 1324. In this embodiment, the second elastic member 142 is a spring, one end of which abuts against a bottom of the installation groove 1323, and the other end abuts against the stop member 141, thereby driving the stop member 141 to slide back and forth. In other embodiments, the second elastic member 142 can also be a rubber or other structure with elastic rebounding characteristics.

Figure 9:
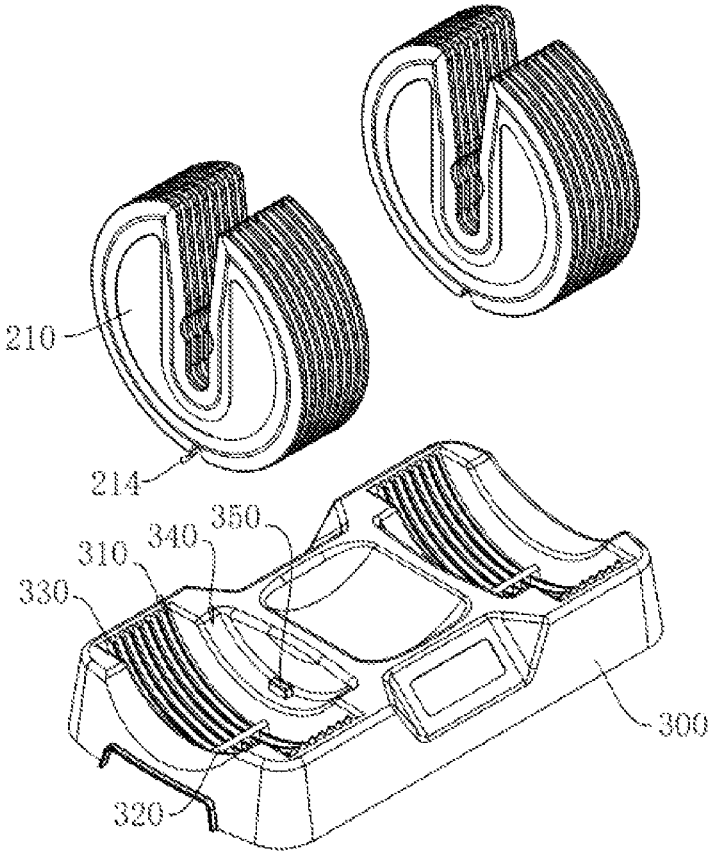
FIG. 9 is an exploded structure view of the dumbbell seat and the counterweight assembly.

Referring to FIG. 9, the dumbbell seat 300 is defined with a receiving groove 310 configured for the dumbbell plates 210 to be inserted in, and the receiving groove 310 is provided with a stop bar 320. The dumbbell plates 210 is defined with a notch 214 configured for the stop bar 320 to be inserted. The engagement between the notch 214 and the stop bar 320 helps to install the dumbbell plates 210 neatly and vertically on the dumbbell seat 300. The receiving groove 310 is defined with a plurality of partition plates 330 at intervals, and the partition plate 330 is configured to divide the stop bar 320 into multiple sections, effectively preventing the dumbbell plates 210 from tipping over and providing some space between the dumbbell plates 210, which makes it easier for the holding rod assembly 100 to quickly engage with the dumbbell plates 210.

The dumbbell seat 300 is defined with an end cap groove 340 configured for the inner end cover 132 to be inserted. The end cap groove 340 is defined with a protrusion, namely an unlocking member 350, and configured to force the stop member 141 to disengage from the limit groove 13111. The unlocking member 350 is configured to force the stop member 141 to disengage from the limit groove 13111 when the holding rod assembly 100 is placed on the dumbbell seat 300, making it easier for a handle assembly and a load-bearing assembly to rotate relative to each other.

The implementation principle of Embodiment 1 is as follows.

Place the counterweight assembly 200 on the dumbbell seat 300, and the unlocking member 350 forces the stop member 141 to disengage from the limit groove 13111. When the handle tube 110 is rotated, it drives the positioning member 124 to spirally move along the guiding groove 1231. The positioning member 124 drives the hanging member 123 to slide axially along the stop groove 1222 to connect combinations of different weights of the dumbbell plates 210, thereby adjusting the weight of the dumbbell. The hanging member 123 is linked by a synchronous rotation of the handle tube 110 and the gear fixing plate 131. When the hanging member 123 is between two gear positions, that is, the hanging member 123 and the dumbbell plate 210 are in a semi-engaged state, the gear fixing plate 131 drives the hanging member 123 to continue to slide axially until the hanging member 123 reaches a set gear position. The hanging member 123 can be automatically adjusted to be fully engaged with the last dumbbell plate 210 to be hung, thus effectively reducing the risk of injury to the user caused by the dumbbell plate 210 falling off during exercise.

Embodiment 2

Figure 10:
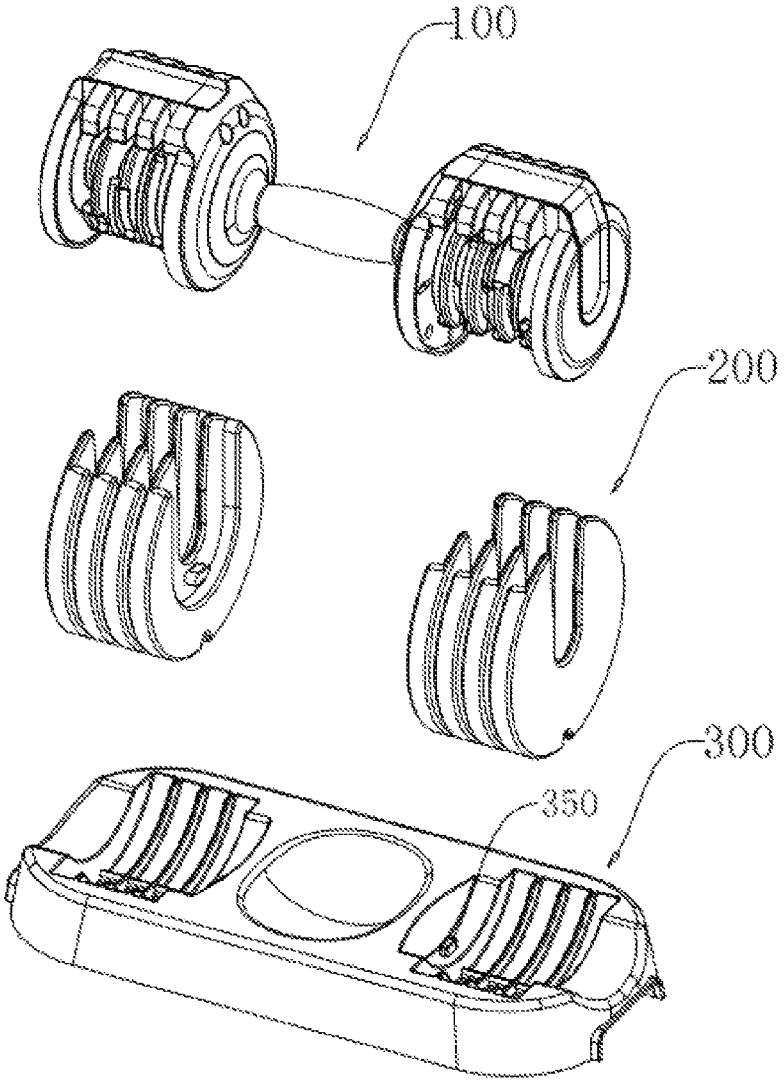
FIG. 10 is an exploded structure view of the weight-adjustable dumbbell.
Figure 11:
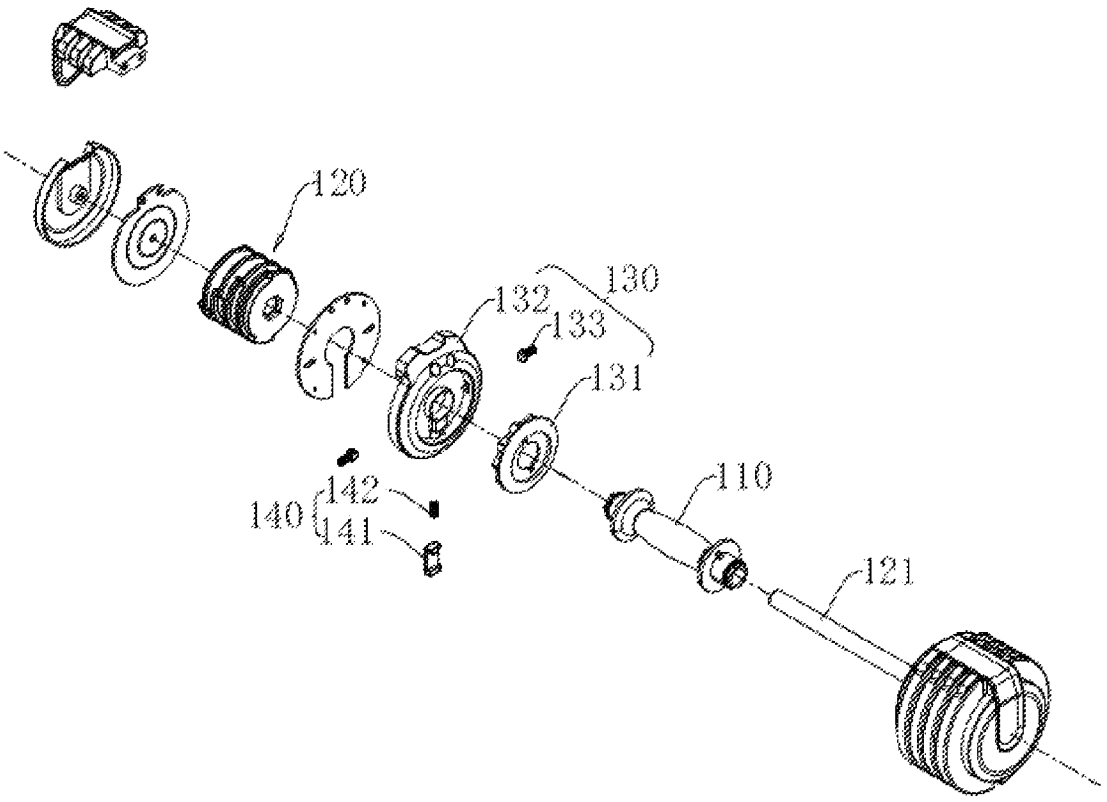
FIG. 11 is an exploded view of the holding rod assembly.

Referring to FIG. 10 and FIG. 11, the counterweight assembly 200 includes at least two dumbbell plates 210. The gear fixing mechanism 130 includes the gear fixing plate 131, the inner end cover 132, and the elastic assembly 133. The gear fixing plate 131 is connected to the handle tube 110 and rotated synchronously with the handle tube 110. The gear fixing plate 131 is linked to the hanging mechanism 120 through the handle tube 110. The hanging mechanism 120 is configured to be rotated synchronously under the drive of the handle tube 110 when the gear fixing plate 131 is rotated.

Figure 12:
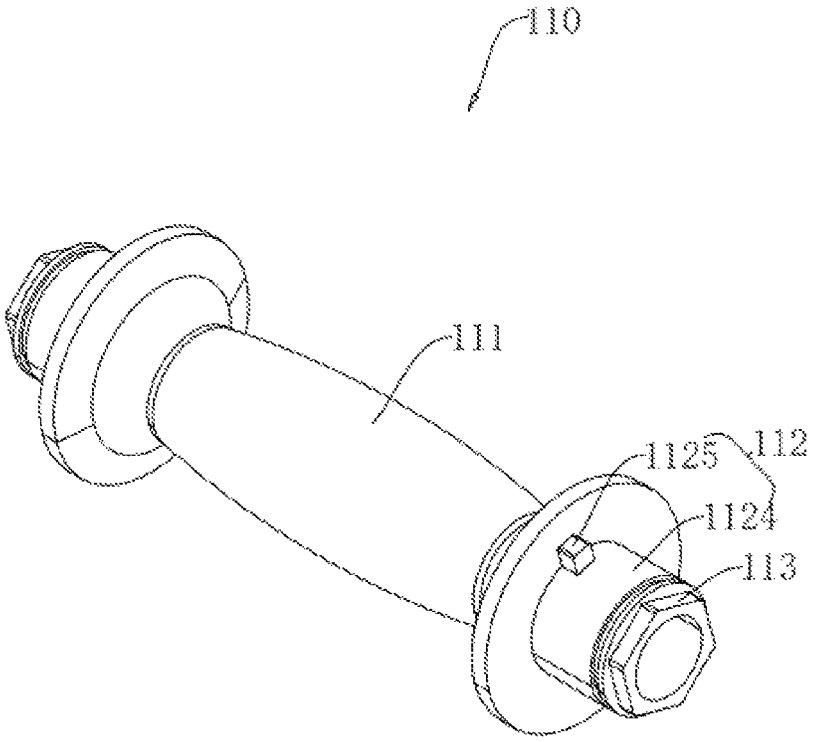
FIG. 12 is a structure view of the handle tube.
Figure 13:
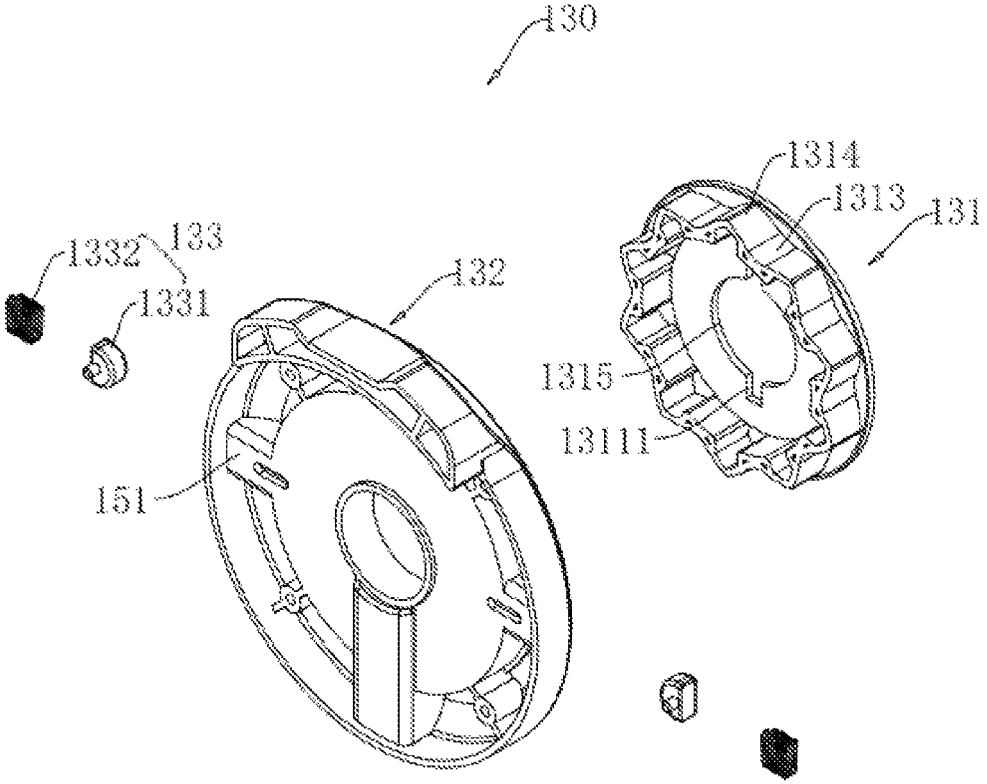
FIG. 13 is a structure view of the gear fixing mechanism.

Referring to FIG. 12 and FIG. 13, the handle tube 110 includes a holding portion 111, and both ends of the holding portion 111 are provided with an installation portions 112. The installation portion 112 is configured to connect the gear fixing plate 131 to rotate synchronously with the handle tube 110. The installation portion 112 includes an installation ring 1124, which extends along a circumferential direction at least one limit protrusion 1125. A center of the gear fixing plate 131 is defined with an installation hole 1315, and a limit groove 1316 corresponding to the limit protrusion 1125 is defined on the installation hole 1315. The gear fixing plate 131 is sleeved on the installation ring 1124 through the installation hole 1315, and the limit protrusion 1125 is configured to be snapped into the limit groove 1316 to fix the gear fixing plate 131 and the handle tube 110 in a circumferential direction.

Referring to FIG. 13, the gear fixing plate 131 is circumferentially defined with a plurality of positioning recesses 1313 at intervals, and each of the positioning recess 1313 corresponds to one of the gear positions of the hanging mechanism 120. The sliding convex portion 1314 is formed between adjacent positioning recesses 1313.

The gear fixing plate 131 is installed rotatably relative to the inner end cover 132, which is a fixed component. The elastic assembly 133 is slidably installed on the inner end cover 132, slides relative to the inner end cover 132, and abuts against the gear fixing plate 131. The elastic assembly 133 constantly has a movement tendency of being moved into the positioning recess 1313. The elastic assembly 133 is configured to drive the hanging mechanism 120 to rotate to a corresponding gear position when the elastic assembly 133 is snapped into the positioning recess 1313.

Referring to FIG. 11, the holding rod assembly 100 includes the central shaft 121, the handle tube 110 is sleeved on the central shaft 121 and configured to rotate relative to the central shaft 121, and the inner end cover 132 is fixedly connected to the central shaft 121, so that the gear fixing plate 131 can rotate relative to the inner end cover 132.

Referring to FIG. 13 to FIG. 16, a first sliding groove 151 is radially defined on an upper edge of the inner end cover 132, and the elastic assembly 133 is slidably installed in the first sliding groove 151. The first sliding groove 151 is open at one end to communicate with the gear fixing plate 131.

The elastic assembly 133 includes the abutting member 1331 and the first elastic member 1332. The first elastic member 1332 is supported between the bottom of the first sliding groove 151 and the abutting member 1331, and configured to exert a force on the gear fixing plate 131 through the abutting member 1331. The abutting member 1331 and the gear fixing plate 131 have a uniform contact surface, so that the abutting member 1331 can reciprocally slide along the first sliding groove 151.

Figure 15:
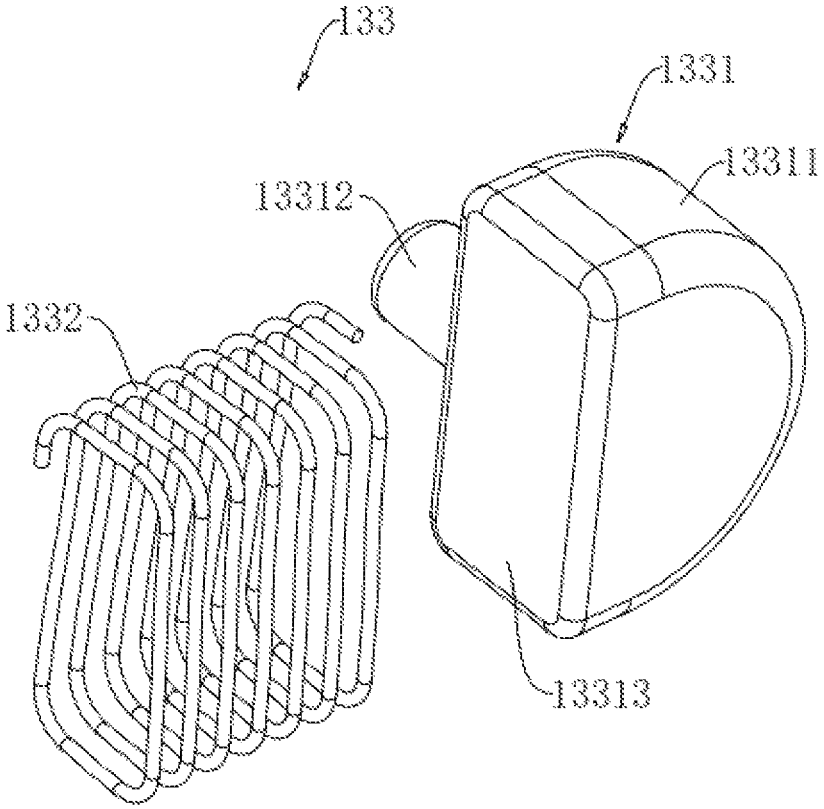
FIG. 15 is a structure view of the elastic assembly in the gear fixing mechanism.

Specifically, referring to FIG. 15, the abutting member 1331 includes the abutting portion 13311, a connecting portion 13313, and a guiding portion 13312. The abutting portion 13311 is a convex surface, such as a cylindrical surface, which constantly abuts against the gear fixing plate 131. When the abutting member 1331 abuts against the sliding convex portion 1314, the abutting portion 13311 is in linear contact with the sliding convex portion 1314, and a linear contact motion causes the abutting member 1331 and the sliding convex portion 1314 to have a tendency of relative motion. Combined with a force of the first elastic member 1332, the abutting member 1331 and the sliding convex portion 1314 move relative to each other along a tangent direction of a contact line, and drive the gear fixing plate 131 to rotate relative to the abutting member 1331 until the abutting member 1331 is snapped into the positioning recess 1313. The sliding convex portion 1314 can be shaped approximately like a pointed end, which can accelerate the relative sliding motion between the abutting portion 13311 and the sliding convex portion 1314.

The positioning recess 1313 is in planar contact with the abutting portion 13311, allowing the abutting portion 13311 to be stably snapped into the positioning recess 1313. At the same time, the positioning recess 1313 is a smoothly transitioning curved surface structure, reducing a sliding friction between the abutting portion 13311 and the positioning recess 1313. This allows the abutting member 1331 to smoothly disengage from the positioning recess 1313 as the handle tube 110 is rotated to adjust the gear position.

Referring to FIG. 15, the connecting portion 13313 is a flat surface, and the first elastic member 1332 is a spring, with both ends of the spring respectively abutting against the connecting portion 13313 and an groove bottom of the first sliding groove 151. The spring is configured to cause the abutting member 1331 to have a tendency to move toward the gear fixing plate 131 in the first sliding groove 151. Preferably, of the spring has a cross-sectional shape matching that of the connecting portion 13313, so that the abutting member 1331 can bear force more evenly and will not deviate or jam due to uneven force during sliding movement. For example, if the cross-section of the connecting portion 13313 is square, the spring described above is a square spring.

The guiding portion 13312 is a guiding column provided on one side of the abutting member 1331, and a side wall of the first sliding groove 151 is defined with a guiding groove 1231. The guiding column is configured to be snapped into the guiding groove 1231 to guide a sliding movement of the abutting member 1331.

Figure 16A:
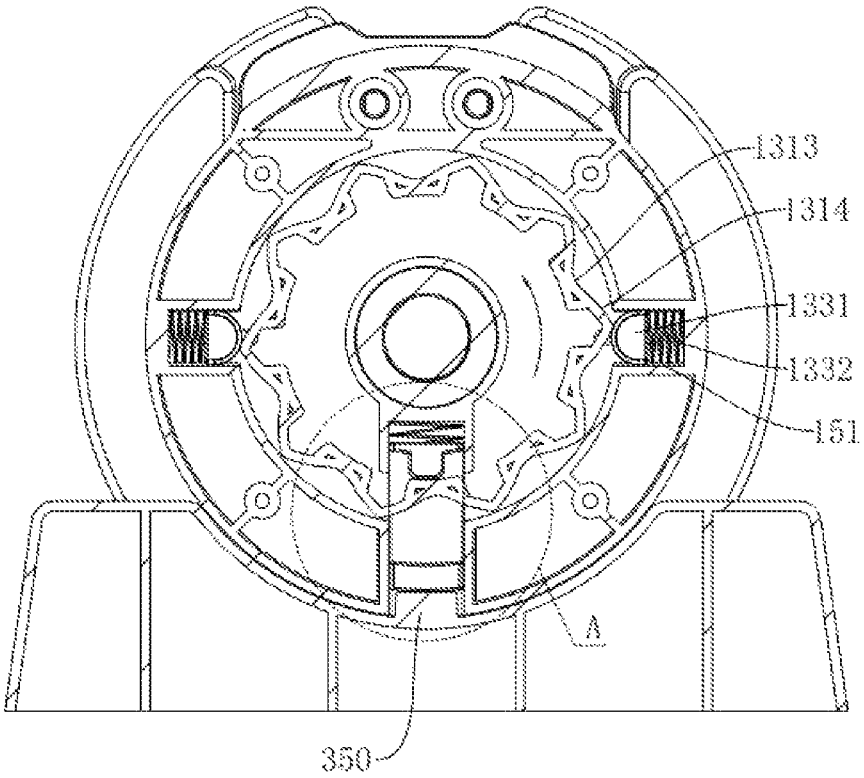
FIG. 16A-FIG. 16B are schematic views of the engagement between the gear fixing plate of the elastic assembly in the gear fixing mechanism.
Figure 16B:
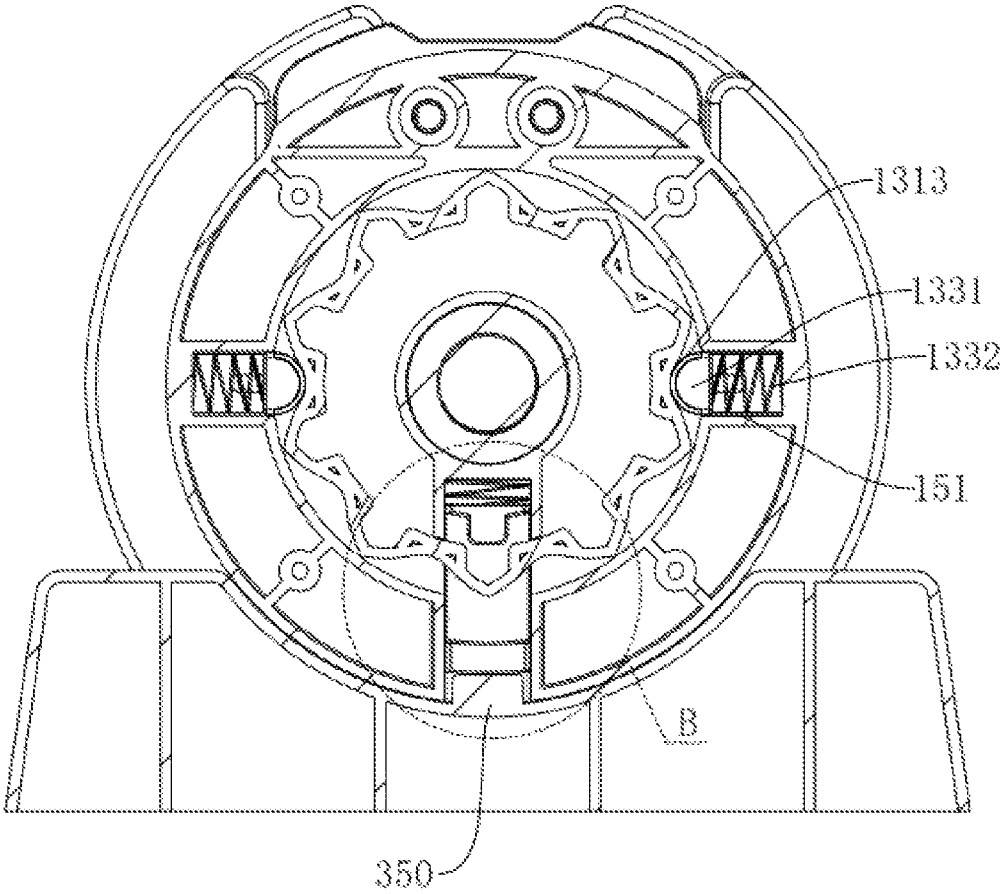

Referring to FIG. 16A, the first elastic member 1332 is configured to exert a force on the gear fixing plate 131 through the abutting member 1331 when the abutting member 1331 abuts against the sliding convex portion 1314, causing the gear fixing plate 131 to have a tendency to continue rotating relative to the inner end cover 132. Referring to FIG. 16B, the gear fixing plate 131 stops rotating when the gear fixing plate 131 is rotated to the abutting member 1331 and snapped into the positioning recess 1313.

Referring to FIG. 17 to FIG. 20, the gear fixing mechanism 130 can also be achieved in the following way.

The inner end cover 132 is radially defined with a guide hole 1325, which includes a contracting cavity 13251 and a restoring cavity 13252, with the restoring cavity 13252 communicating with the contracting cavity 13251 and the gear fixing plate 131, and a diameter of the restoring cavity 13252 is larger than that of the contracting cavity 13251.

The elastic assembly 133 is an integrated structure, including the abutting portion 13311, the connecting portion 13313, and an elastic rebounding portion 13314. The elastic rebounding portion 13314 is arranged near the periphery of the abutting portion 13311, and is connected to the abutting portion 13311 through the connecting portion 13313. Multiple elastic rebounding portions 13314 can be arranged along the periphery of the abutting portion 13311. In this embodiment, two elastic rebounding portions 13314 are symmetrically arranged near the periphery of the abutting portion 13311.

The elastic rebounding portion 13314 includes a rebounding segment **13314*a* and a connecting segment 13314*b* integrally formed near the periphery of the abutting portion 13311, with a gap between the rebounding segment 13314*a* and the abutting portion 13311, the rebounding segment 13314*a* is configured to abut against an inner wall of the restoring cavity 13252. The connecting segment 13314*b* connects the rebounding segment 13314*a* and the connecting portion 13313. The rebounding segment 13314*a* is configured to be compressed by an external force to move toward the abutting portion 13311** or resiliently rebound to place under an elastic force.

Figure 20A:
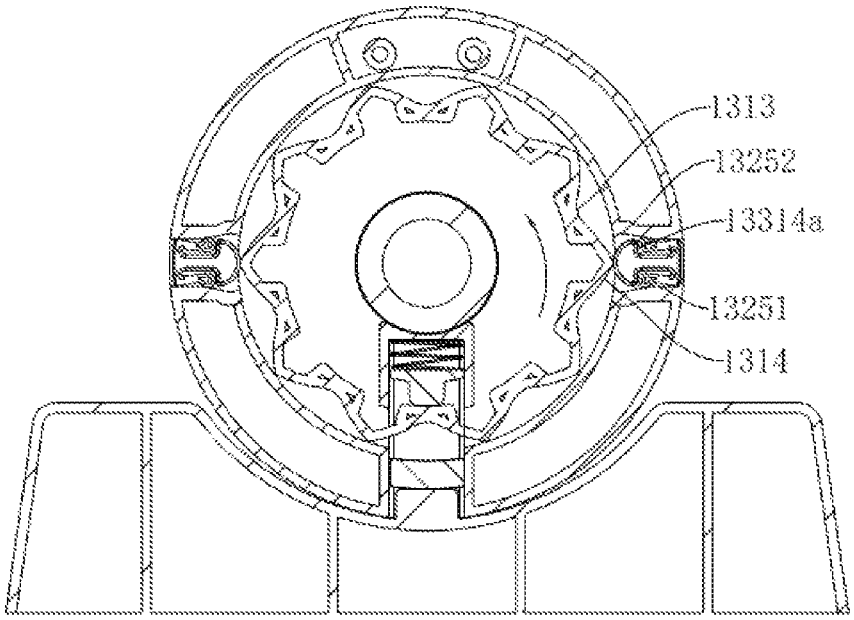
FIG. 20A-FIG. 20B are schematic views of the engagement between the gear fixing plate of the elastic assembly in the gear fixing mechanism.
Figure 20B:
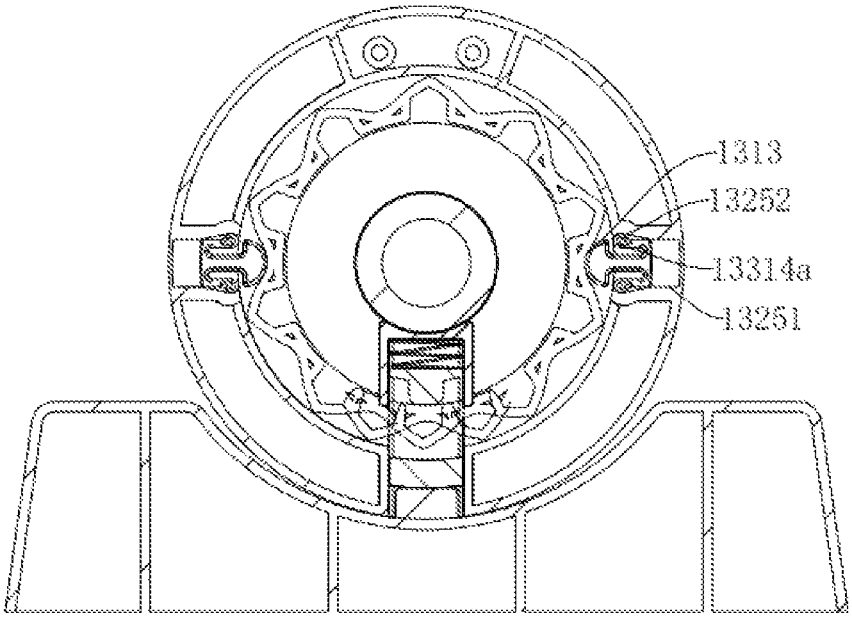

Referring to FIG. 20A and FIG. 20B, the elastic assembly 133 is configured to slide in a direction away from the gear fixing plate 131 in the guide hole 1325 when the sliding convex portion 1314 abuts against the abutting part 13311, and the abutting portion 13311 retracts into the contracting cavity 13251, and the rebounding segment **13314*a* moves toward the contracting cavity 13251 and is compressed against the abutting portion 13311 under the limitation of the inner wall of the restoring cavity 13252, thereby having elastic potential energy for rebounding. The elastic potential energy for rebounding pushes the abutting portion 13311 against the sliding convex portion 1314, thereby driving the gear fixing plate 131 to rotate until the rebounding segment 13314*a* rebounds in the restoring cavity 13252, and then the abutting portion 13311 is inserted into the positioning recess 1313**.

Preferably, at least two the elastic assembly 133 can be arranged circumferentially along the inner end cover 132 at intervals. By collectively exerting force on the gear fixing plate 131, an effect of the elastic assembly 133 on the gear fixing plate 131 is increased and further ensure that the elastic assembly 133 can be inserted into the positioning recess 1313.

Optionally, the hanging mechanism 120 can include two symmetrical hanging assemblies arranged at both ends of the handle tube 110, each hanging assembly includes a plurality of hanging plates 125 arranged adjacent and rotating in synchronization. The number of hanging plates matches that of the dumbbell plates, and the hanging plate 125 is configured to hang or loosen its corresponding dumbbell plate during rotation. Both ends of the handle tube 110 can be provided with a transmission portion 113, which can be a diamond-shaped ring arranged on the handle tube 110, and a diamond-shaped hole is correspondingly defined on the hanging plates 125. The hanging plates 125 are configured to rotate synchronously with the handle tube 110 through a cooperation of the diamond-shaped hole and the diamond-shaped ring.

Figure 21:
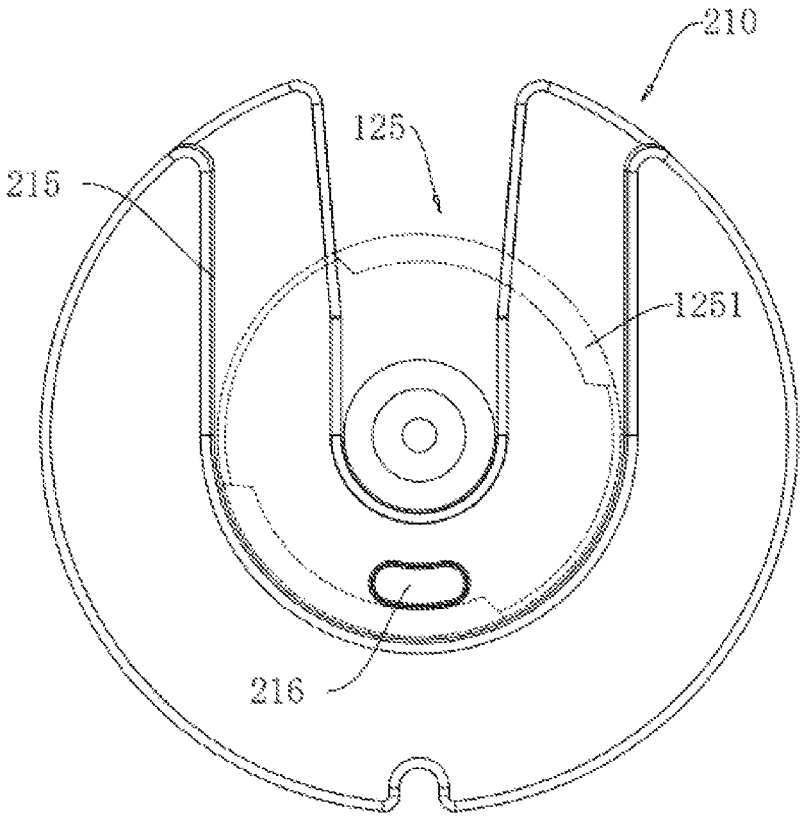
FIG. 21 is schematic view of the engagement between the hanging plate and the dumbbell plate.

Referring to FIG. 21, an engagement between the hanging plate 125 and the dumbbell plate 210 is achieved by the following method. Arc-shaped hanging bars 1251 are circumferentially provided along each of the hanging plate 125. On one group of the hanging assembly, the number of the hanging bars 1251 on adjacent hanging plates is gradually increased or decreased. Each of the dumbbell plate 210 is defined with an U-shaped groove 215 configured for the hanging plates 125 to be inserted. At the same time, a positioning block 216 is provided on an inner wall of the U-shaped groove 215. The hanging bar 1251 is configured to be rotated and inserted between the positioning block 216 and a bottom wall of the U-shaped groove 215 when the hanging plate 125 is rotated, and the hanging plate 125 is engaged with the dumbbell plate 210. When an end of the hanging bar 1251 is inserted into the U-shaped groove 215 and tangent to an arc surface of the positioning block 216, the hanging plate 125 is semi-engaged with the dumbbell plate 210.

Figure 22:
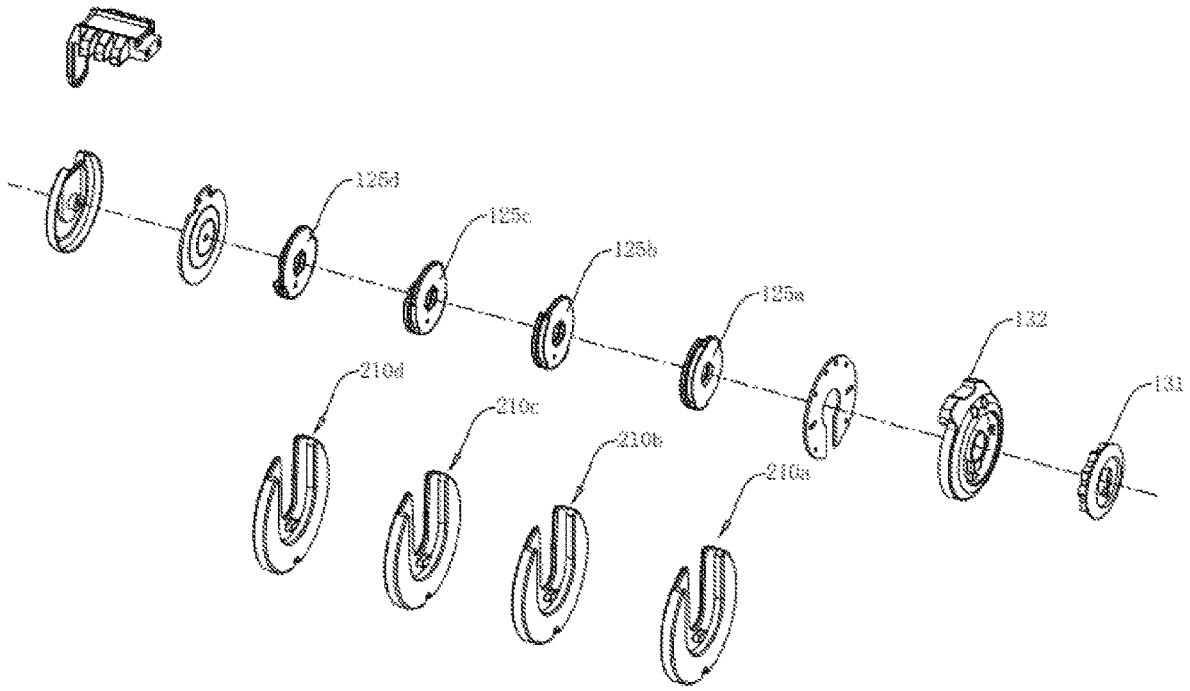
FIG. 22 is schematic view of the engagement between the hanging assembly and the counterweight assembly.

Referring to FIG. 22, the working state of the gear fixing mechanism 130 is illustrated in details by taking a hanging assembly formed by four hanging plates 125 as an example when the hanging plate is rotated to be hung on or loosened from the dumbbell plate.

Each of the hanging assembly is centered on the handle tube 110 and includes, from inside to outside, a first hanging plate 125*a*, a second hanging plate 125*b*, a third hanging plate 125*c*, and a fourth hanging plate 125*d*, with two hanging bars symmetrically arranged on each of the hanging plate. Among them, a central angle corresponding to the hanging bar on the first hanging plate 125*a* is 144°, that on the second hanging plate 125*b* is 108°, that on the third hanging plate 125*c* is 72°, and that on the fourth hanging plate 125*d* is 36°.

The counterweight assembly 200 includes, from inside to outside, a first dumbbell plate 210*a*, a second dumbbell plate 210*b*, a third dumbbell plate 210*c*, and a fourth dumbbell plate 210*d* that correspond to each hanging plate. Weight of each dumbbell plate can be the same or different. The central angle corresponding to each pair of adjacent positioning recess 1313 on the gear fixing plate 131 is 36°. In this embodiment, the dumbbell has five gear positions that adjust as the hanging assembly rotates. The five gear positions are as follow.

A neutral gear position (no dumbbell plates engaged): The holding rod assembly 100 is placed on the counterweight assembly 200 without load, and no dumbbell plates are engaged on the hanging assembly.

A first gear position (two dumbbell plates engaged): Rotate the handle tube 110 from the neutral gear position in one direction (counterclockwise or clockwise) by 36°, and the first hanging plate 125*a* engages two of the first dumbbell plate 210*a*.

A second gear position (four dumbbell plates engaged): Continue to rotate the handle tube 110 by 36°, and the first hanging plate 125*a* engages two of the first dumbbell plate 210*a*, while the second hanging plate 125*b* engages two of the second dumbbell plates 210*b*.

A third gear position (six dumbbell plates engaged): Continue to rotate the handle tube 110 by 36°, and the first hanging plate 125*a* engages two of the first dumbbell plate 210*a*, the second hanging plate 125*b* engages two of the second dumbbell plates 210*b*, and the third hanging plate 125*c* engages two of the third dumbbell plates 210*c*.

A fourth gear position (eight dumbbell plates engaged): Continue to rotate the handle tube 110 by 36°, and the first hanging plate 125*a* engages two of the first dumbbell plate 210*a*, the second hanging plate 125*b* engages two of the second dumbbell plates 210*b*, the third hanging plate 125*c* engages two of the third dumbbell plates 210*c*, and the fourth hanging plate 125*d* engages two of the fourth dumbbell plate 210*d*.

When the hanging assembly is in one of the five gear positions described above, the elastic assembly 133 is inserted into the positioning recess 1313, and at this time, the dumbbell can be lifted for exercise. If the hanging assembly is between adjacent gear positions, the elastic assembly 133 abuts against the sliding convex portion 1314, and under the elastic potential energy, pushes the gear fixing plate 131 to continue rotating, which in turn drives the hanging assembly to rotate through the handle tube 110 until the elastic assembly 133 inserts into the positioning recess 1313 adjacent to the sliding convex portion 1314, at which point the hanging assembly also rotates to a corresponding gear position, and the hanging plates is engaged with the dumbbell plates.

The positioning recess 1313 can be uniformly arranged on an outer circumferential surface of the gear fixing plate 131. In this embodiment, ten positioning recess 1313 are circumferentially arranged along the gear fixing plate 131, and each rotation of the gear fixing plate 131 can achieve a cyclic adjustment of two turns of gear positions.

Figure 17:
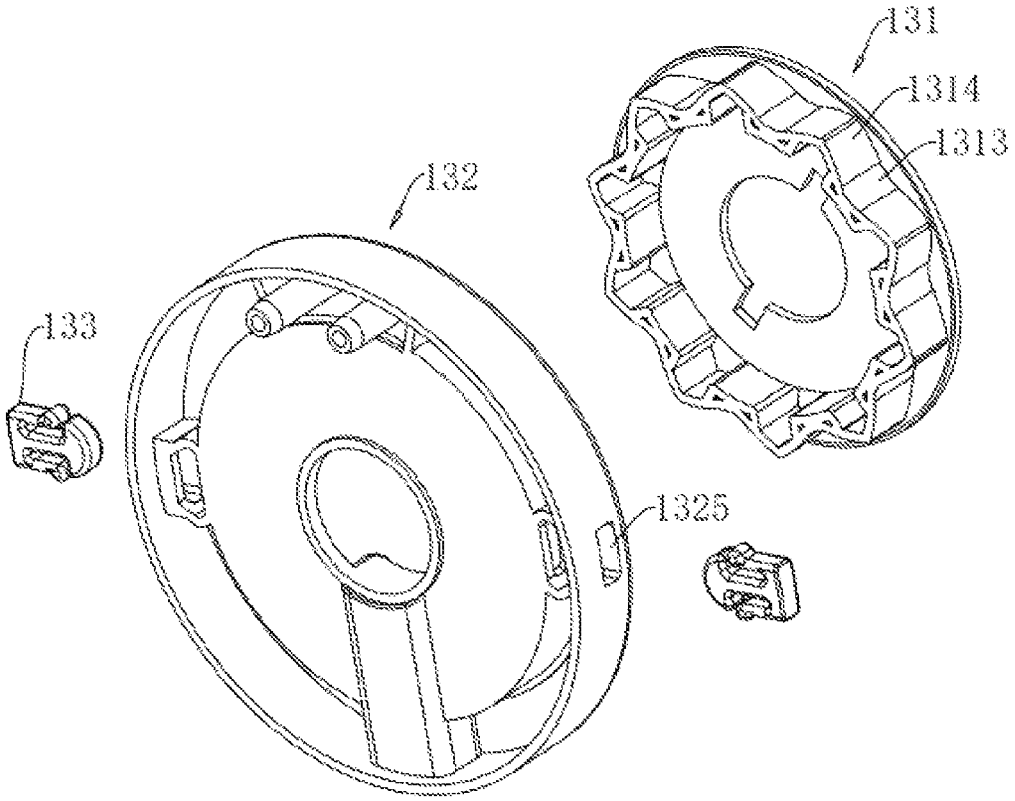
FIG. 17 is a structure view of the gear fixing mechanism.

Referring to FIG. 11, the stop mechanism 140 includes a stop member 141 and a second elastic member 142. Referring to FIG. 15 and FIG. 17, the gear fixing plate 131 is defined with limit grooves 13111. When the stop member 141 is inserted into the limit groove 13111, the rotation of the gear fixing plate 131 is locked, and the gear fixing plate 131 is fixed relative to the inner end cover 132, and the rotation of the handle tube 110 is also locked. The gear fixing plate 131 is configured to rotate relative to the inner end cover 132 when the stop member 141 disengages from the limit groove 13111, and the rotation of the handle tube 110 is unlocked.

Figure 14:
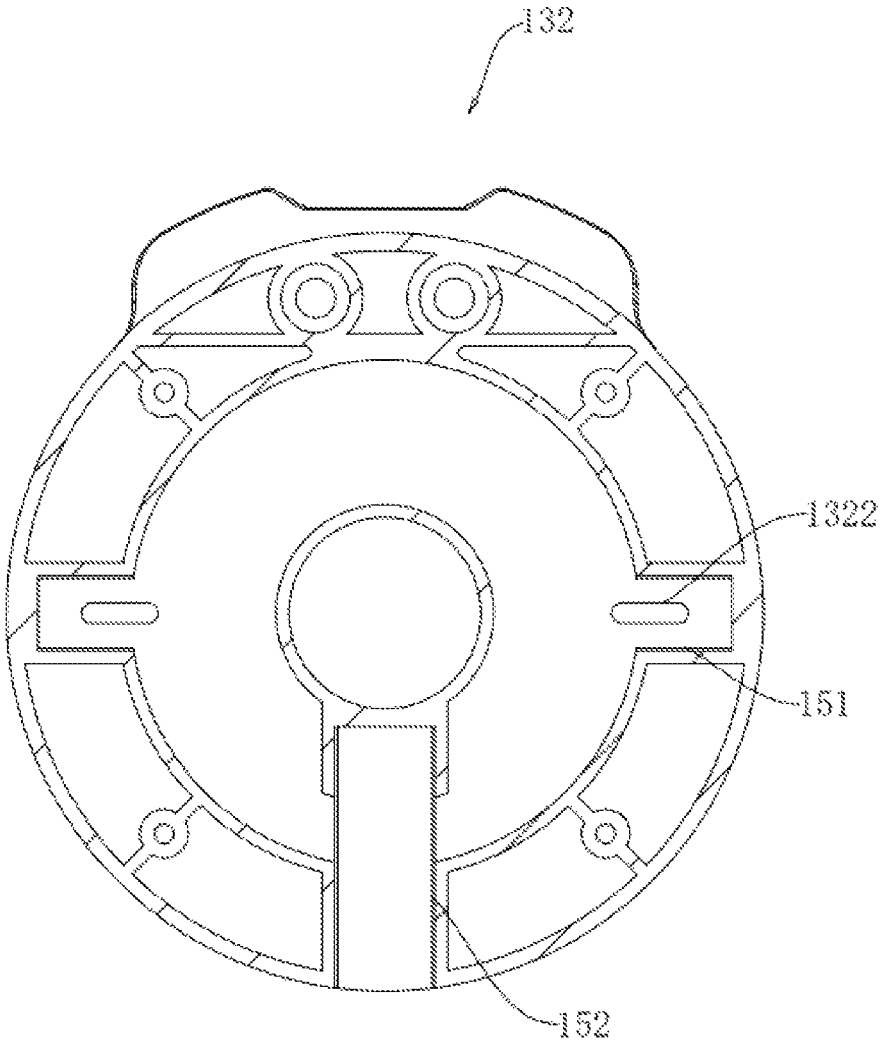
FIG. 14 is a cross-section view of the inner end cover in the gear fixing mechanism.
Figure 18:
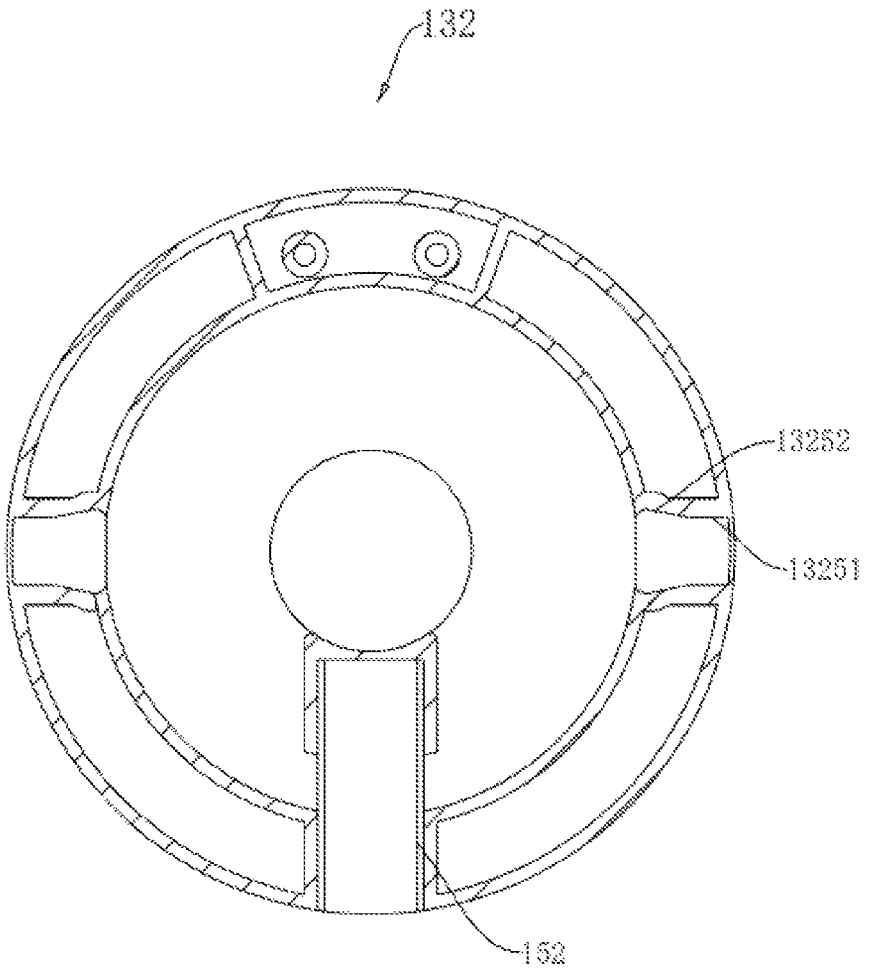
FIG. 18 is a cross-section view of the inner end cover in the gear fixing mechanism.
Figure 19:
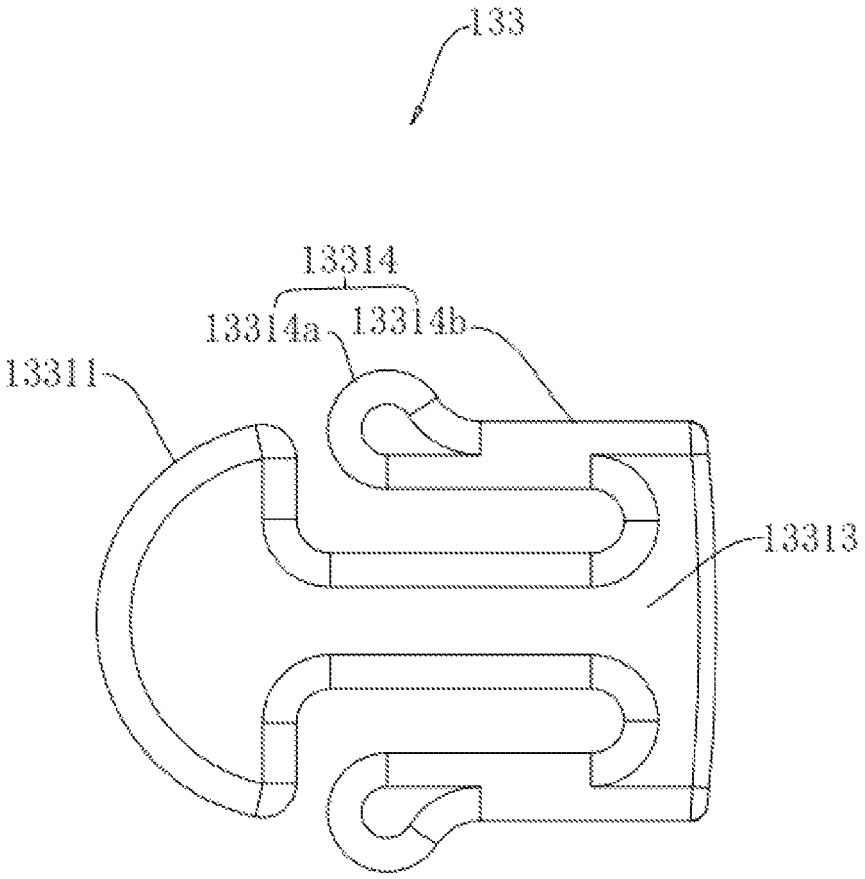
FIG. 19 is a structure view of the elastic assembly in the gear fixing mechanism.

Referring to FIG. 14 and FIG. 18, the inner end cover 132 is radially defined with the snap-in groove 1324, in which the stop member 141 is slidably installed, and the second elastic member 142 is supported between a bottom of the snap-in groove 1324 and the stop member 141. The stop member 141 constantly has a tendency to be inserted into the limit groove 13111 under an action of the second elastic member 142.

Referring to FIG. 18, the dumbbell seat 300 is used to place the counterweight assembly 200, and is provided with the unlocking member 350. The unlocking member 350 is configured to act on the stop member 141 to disengage the stop member 141 from the limit groove 13111 to unlock the rotation of the gear fixing plate 131.

Figure 23:
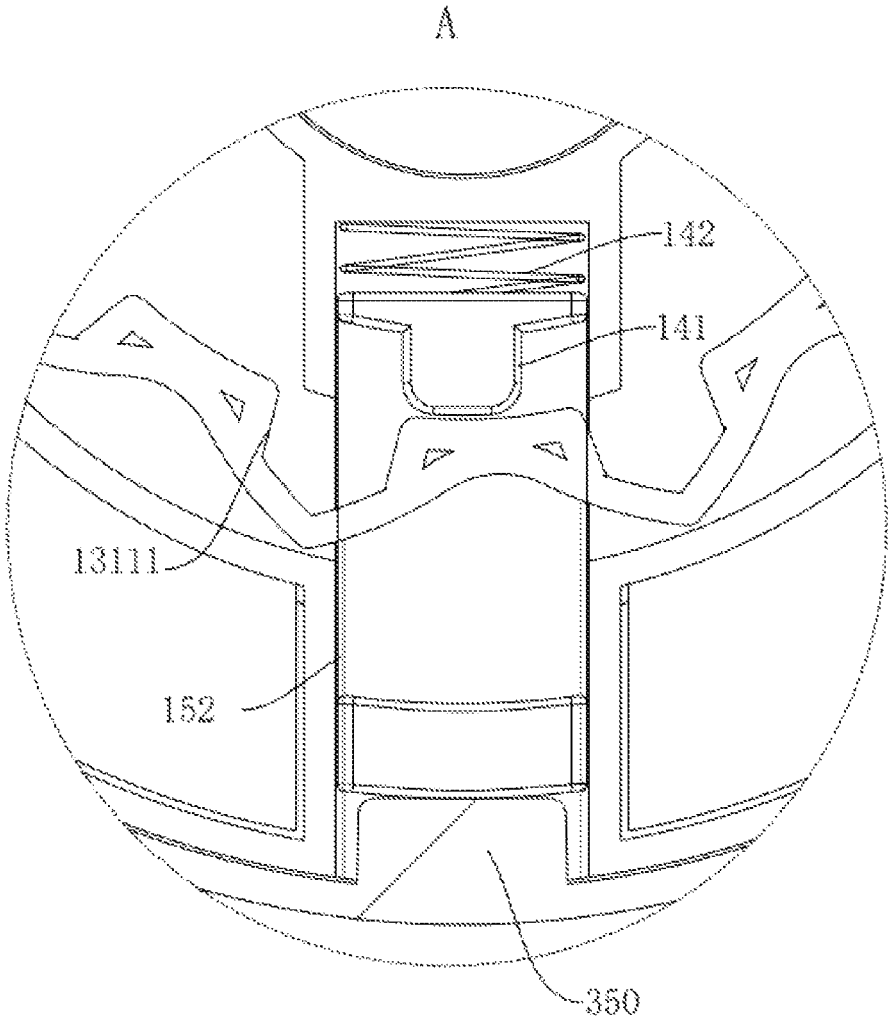
FIG. 23 is a partial enlarged view of Part A in FIG. 16A.
Figure 24:
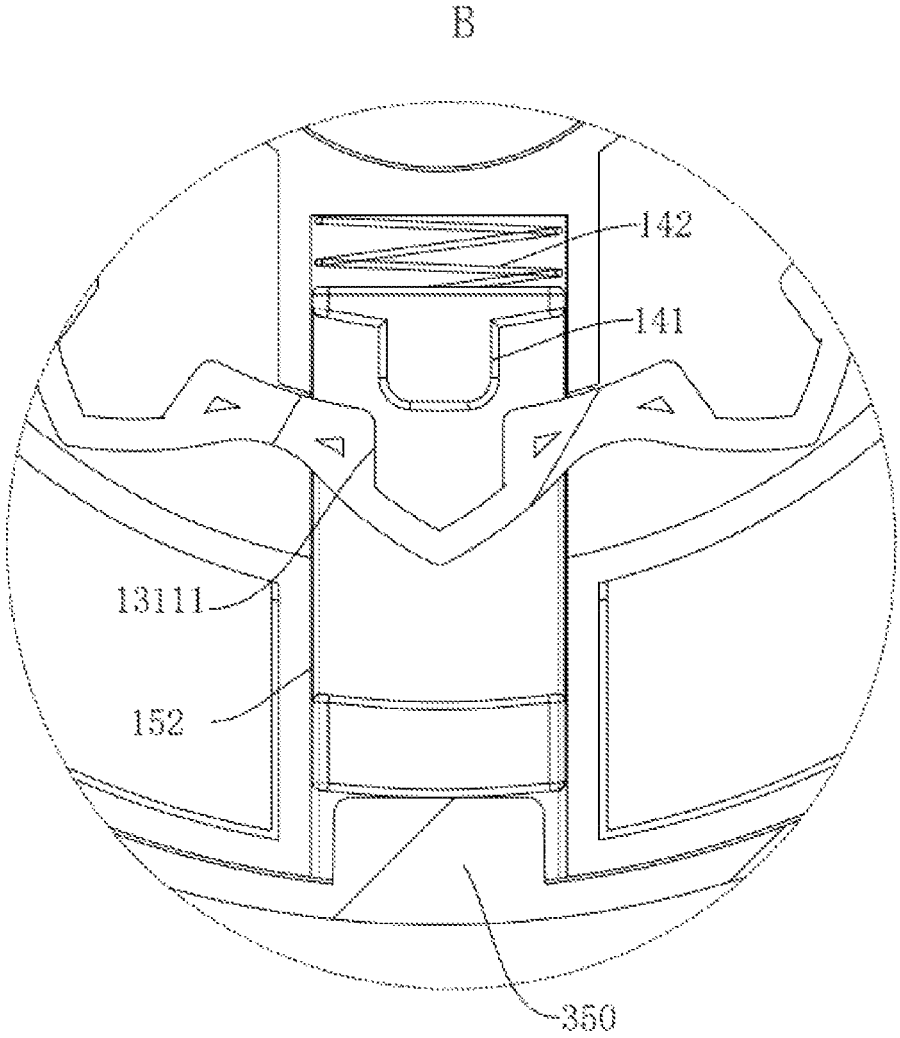
FIG. 24 is a partial enlarged view of Part B in FIG. 16B.

Referring to FIG. 23 and FIG. 24, the unlocking member 350 is a protrusion defined on the dumbbell seat 300, the unlocking member 350 is configured to abut against the stop member 141 through a bottom opening of the limit groove 13111 when the holding rod assembly 100 is placed on the dumbbell seat 300, causing the stop member 141 to overcome a resistance of the second elastic member 142 and move toward an axis direction of the inner end cover 132, disengaging from the limit groove 13111. At this point, the gear fixing plate 131 can rotate relative to the inner end cover 132, and the user can adjust the gear position by rotating the handle tube 110. If the holding rod assembly 100 is lifted from the dumbbell seat 300, the unlocking member 350 is disengaged from the limit groove 13111, and the stop member 141 is inserted into the limit groove 13111 under the action of the second elastic member 142, locking the rotation of the gear fixing plate 131.

Preferably, the limit groove 13111 can be installed on an inner peripheral surface of the gear fixing plate 131, and arranged corresponding to the gear position of the hanging mechanism 120. When the gear position is adjusted by rotating the handle tube 110, the gear fixing plate 131 rotates accordingly and the elastic assembly 133 is inserted into the positioning recess 1313 corresponding to the gear position. At the same time, the limit groove 13111 rotates to a position corresponding to the stop member 141, and when the dumbbell is lifted from the dumbbell seat 300, the stop member 141 is inserted into the limit groove 13111 under the action of the second elastic member 142, locking the rotation of the gear fixing plate 131.

The implementation principle of Embodiment 2 is as follows.

When adjusting the gear position by placing the holding rod assembly 100 on the dumbbell seat 300, the unlocking member 350 pushes the stop member 141 out of the limit groove 13111, unlocking the rotation of the gear fixing plate 131. The user can adjust the gear position by rotating the handle tube 110, which drives the hanging mechanism 120 to rotate synchronously, and the gear fixing plate 131 rotates synchronously with the handle tube 110. During the rotation of the gear fixing plate 131, when the hanging plate 125 is in a semi-engaged state with the dumbbell plate 210, the elastic assembly 133 continues to rotate the gear fixing plate 131 until it is snapped into the positioning recess 1313. At this time, the hanging plate 125 is engaged with the dumbbell plate 210, and the gear position adjustment is completed. Then, when lifting the dumbbell, the stop member 141 is snapped into the corresponding limit groove 13111, locking the rotation of the gear fixing plate 131, and the exercise can be performed.

What is provided above is merely the preferred embodiments according to the present application, and the protection scope of the present application is not limited to the above embodiments. On the contrary, all the technical solutions obtained based on the concepts of the present application should fall with in the protection scope of the present application. It should be noted that, for those skilled in the art, some improvements and modifications can be made without departing from the principles of the present applications, which should be also considered as falling within the protection scope of the present application.

What is claimed is:

1. A weight-adjustable dumbbell, comprising:

a holding rod assembly comprising a handle tube, a hanging mechanism, and a gear fixing mechanism; and a counterweight assembly connected to the holding rod assembly and comprising at least one dumbbell plate;

wherein the handle tube is rotatably installed, and the hanging mechanism is connected to the handle tube and rotated synchronously with the handle tube;

wherein the hanging mechanism is defined with a plurality of gear positions rotating relative to the counterweight assembly under a drive of the handle tube, and the hanging mechanism is configured to connect to at least one dumbbell plate when the hanging mechanism is rotated to one of the plurality of gear positions; and wherein the gear fixing mechanism is connected to the hanging mechanism and rotated synchronously with the hanging mechanism, and the gear fixing mechanism maintains the hanging mechanism to have a movement tendency of rotating toward the one of the plurality of gear positions.

2. The weight-adjustable dumbbell according to claim 1, wherein the holding rod assembly further comprises a stop mechanism installed on an inner end cover and configured to lock a rotation of a gear fixing plate or unlock the rotation of the gear fixing plate.

3. The weight-adjustable dumbbell according to claim 2, wherein the weight-adjustable dumbbell further comprises a dumbbell seat configured to receive the counterweight assembly and provided with an unlocking assembly configured to unlock the rotation of the gear fixing plate when the holding rod assembly is placed on the dumbbell seat.

4. The weight-adjustable dumbbell according to claim 3, wherein a notch is defined at a bottom of the at least one dumbbell plate, and the dumbbell seat is provided with a stop bar configured to be inserted into the notch.

5. The weight-adjustable dumbbell according to claim 2, wherein the handle tube is provided with a synchronously rotated positioning member, and the hanging mechanism comprises:

a load-bearing member connected to the handle tube, rotated relative to the handle tube, and defined with at least one stop groove; and a hanging member connected to the handle tube and provided with a spiral guide groove for the synchronously rotated positioning member to spirally move along the spiral guide groove and a stop block matching the at least one stop groove to slide axially along the at least one stop groove.

6. The weight-adjustable dumbbell according to claim 5, wherein the at least one dumbbell plate is defined with a hanging opening matching the hanging member and configured for an axial insertion of the hanging member, and a rotation stop notch communicating with the hanging opening and configured for the load-bearing member to snap in, with an opening at a joint between the rotation stop notch and the hanging opening being smaller than the hanging opening.

7. The weight-adjustable dumbbell according to claim 5, wherein the handle tube comprises a holding portion and an installation portion connected to an end of the holding portion, the installation portion is provided with a snap base on one side departing from the holding portion, and the snap base is configured to be in snap connection with a ring hole of a gear fixing ring, and defined with a perforation for installing the synchronously rotated positioning member.

8. The weight-adjustable dumbbell according to claim 1, wherein the gear fixing mechanism comprises:

a gear fixing plate connected to the handle tube and rotated synchronously with the handle tube, wherein the gear fixing plate is circumferentially defined with a plurality of positioning recesses at intervals, and each of the plurality of positioning recesses corresponds to one of the plurality of gear positions respectively;

an inner end cover, wherein the gear fixing plate is rotatably installed on the inner end cover; and an elastic assembly, wherein the elastic assembly is slidably installed on the inner end cover, abuts against the gear fixing plate, and constantly has a movement tendency of being moved into one of the plurality of positioning recesses;

wherein the hanging mechanism is configured to be rotated to a corresponding positioning recess of the plurality of positioning recesses when the elastic assembly is snapped into the one of the plurality of positioning recesses.

9. The weight-adjustable dumbbell according to claim 8, wherein a sliding convex portion is formed between two adjacent positioning recesses of the plurality of positioning recesses, and the elastic assembly is in linear contact with the sliding convex portion.

10. The weight-adjustable dumbbell according to claim 9, wherein a sliding groove is defined in the inner end cover, and the elastic assembly is slidably installed in the sliding groove; wherein the elastic assembly comprises:

an abutting member abutting against the gear fixing plate; and an elastic member supported between the abutting member and a bottom of the sliding groove.

11. The weight-adjustable dumbbell according to claim 10, wherein the abutting member comprises a connecting surface, the elastic member comprises a spring, and the spring abuts against the connecting surface and the bottom of the sliding groove.

12. The weight-adjustable dumbbell according to claim 9, wherein a guide hole is defined in the inner end cover, and the elastic assembly is slidably installed in the guide hole; wherein the elastic assembly is an integrated structure, comprising:

an abutting portion abutting against the gear fixing plate; and an elastic rebounding portion, wherein the elastic rebounding portion is connected to the abutting portion and arranged near a periphery of the abutting portion, with a gap between the elastic rebounding portion and the abutting portion, and the elastic rebounding portion is configured to slidably abut against an inner wall of the guide hole;

wherein the elastic rebounding portion is configured to be compressed by the inner wall of the guide hole to move away from the gear fixing plate, and rebound under an action of elastic potential energy to move toward the gear fixing plate.

13. The weight-adjustable dumbbell according to claim 12, wherein the guide hole comprises a contracting cavity and a restoring cavity interconnected with each other, a size of the restoring cavity is larger than that of the contracting cavity, and the elastic rebounding portion is configured to be compressed to move toward the contracting cavity or rebound to move toward the restoring cavity.

* * * * *